US008555465B2

(12) United States Patent
Novin

(10) Patent No.: US 8,555,465 B2
(45) Date of Patent: Oct. 15, 2013

(54) DETENT HINGE

(75) Inventor: Eugene Novin, Blue Bell, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 13/340,972

(22) Filed: Dec. 30, 2011

(65) Prior Publication Data

US 2012/0174339 A1 Jul. 12, 2012

Related U.S. Application Data

(60) Provisional application No. 61/429,114, filed on Jan. 1, 2011.

(51) Int. Cl.
*E05C 17/64* (2006.01)
*E05D 11/08* (2006.01)

(52) U.S. Cl.
USPC ..... 16/342

(58) Field of Classification Search
USPC ..... 16/337, 342, 340, 338, 387–389, 334, 16/335, 331
See application file for complete search history.

(56) References Cited

U.S. PATENT DOCUMENTS

| | | | | |
|---|---|---|---|---|
| 4,244,081 | A | | 1/1981 | Beyer et al. |
| D263,370 | S | | 3/1982 | Bisbing |
| D263,446 | S | | 3/1982 | Bisbing |
| D268,733 | S | | 4/1983 | Bisbing |
| D269,943 | S | | 8/1983 | Bisbing |
| 4,490,884 | A | | 1/1985 | Vickers |
| D278,309 | S | | 4/1985 | Vickers |
| D284,931 | S | | 8/1986 | Bisbing |
| 4,630,332 | A | | 12/1986 | Bisbing |
| 4,630,333 | A | | 12/1986 | Vickers |
| 4,693,187 | A | | 9/1987 | Bisbing |
| 4,718,127 | A | | 1/1988 | Rittmann et al. |
| 4,735,151 | A | | 4/1988 | Bisbing |
| 4,829,633 | A | | 5/1989 | Kassner |
| D303,491 | S | | 9/1989 | Bisbing |
| D303,492 | S | | 9/1989 | Bisbing |
| 5,150,500 | A | | 9/1992 | Bisbing |
| 5,165,509 | A | * | 11/1992 | Kanno et al. ..... 192/44 |
| D339,051 | S | | 9/1993 | Bisbing |
| D339,052 | S | | 9/1993 | Bisbing |

(Continued)

FOREIGN PATENT DOCUMENTS

| | | | | |
|---|---|---|---|---|
| JP | 2001227528 | A | * | 8/2001 |
| JP | 2004023469 | A | * | 1/2004 |
| KR | 2005075119 | A | * | 7/2005 |

OTHER PUBLICATIONS

Photographs of a hinge for a DVD display used in the Honda Odyssey Minivan. (File name: hinge_1.pdf.).

(Continued)

*Primary Examiner* — Chuck Mah
(74) *Attorney, Agent, or Firm* — Paul & Paul

(57) ABSTRACT

A detent hinge assembly includes a spring that biases one or more needle rollers into engagement with the outer surface of the hinge shaft. The needle rollers engage one or more grooves in the surface of the hinge shaft to provide the detent function of the hinge. The spring is in the form of a resilient band that surrounds at least a portion of the circumference of the hinge shaft. The spring is provided with a depression that faces the surface of the hinge shaft and that receives a portion of the needle roller.

16 Claims, 43 Drawing Sheets

(56) References Cited

U.S. PATENT DOCUMENTS

| | | | | |
|---|---|---|---|---|
| D339,281 | S | 9/1993 | Bisbing | |
| D339,518 | S | 9/1993 | Bisbing | |
| 5,276,945 | A * | 1/1994 | Matsumura | 16/337 |
| D344,667 | S | 3/1994 | Riblett et al. | |
| D348,823 | S | 7/1994 | Bisbing | |
| 5,412,842 | A | 5/1995 | Riblett | |
| 5,464,083 | A | 11/1995 | Arnold et al. | |
| 5,491,874 | A | 2/1996 | Lowry et al. | |
| 5,564,163 | A | 10/1996 | Lowry et al. | |
| D385,475 | S | 10/1997 | Bolinas et al. | |
| 5,697,125 | A | 12/1997 | Gannon | |
| 5,752,293 | A | 5/1998 | Lowry et al. | |
| 5,765,263 | A | 6/1998 | Bolinas et al. | |
| 5,771,539 | A | 6/1998 | Wahlstedt et al. | |
| 5,787,549 | A | 8/1998 | Soderlund | |
| 5,894,633 | A | 4/1999 | Kaneko | |
| 5,901,415 | A | 5/1999 | Morrison et al. | |
| 5,913,351 | A | 6/1999 | Miura | |
| 5,915,441 | A | 6/1999 | Schlack | |
| 5,970,580 | A | 10/1999 | Katoh | |
| D425,774 | S | 5/2000 | Ford et al. | |
| 6,141,831 | A | 11/2000 | Novin et al. | |
| 6,154,925 | A | 12/2000 | Miura | |
| 6,178,598 | B1 | 1/2001 | Creely, III et al. | |
| 6,182,330 | B1 | 2/2001 | Novin et al. | |
| D439,130 | S | 3/2001 | Ford et al. | |
| 6,271,489 | B1 | 8/2001 | Engel et al. | |
| 6,292,981 | B1 | 9/2001 | Ford et al. | |
| RE37,712 | E | 5/2002 | Gannon | |
| 6,421,878 | B1 | 7/2002 | Kaneko et al. | |
| 6,427,288 | B1 | 8/2002 | Saito | |
| 6,481,056 | B1 * | 11/2002 | Jesse | 16/334 |
| 6,530,123 | B1 | 3/2003 | Wahlstedt | |
| 6,588,062 | B2 | 7/2003 | Novin et al. | |
| 6,618,903 | B2 | 9/2003 | Kim | |
| 6,662,405 | B2 | 12/2003 | Vitry | |
| 6,871,384 | B2 | 3/2005 | Novin et al. | |
| 6,886,222 | B2 | 5/2005 | Vitry | |
| 6,941,617 | B2 | 9/2005 | Pinto | |
| 7,065,834 | B2 | 6/2006 | Lowry | |
| 7,320,152 | B2 | 1/2008 | Lowry et al. | |
| 7,461,432 | B2 * | 12/2008 | Lowen et al. | 16/334 |
| 7,607,202 | B1 * | 10/2009 | Lee | 16/342 |
| 7,698,785 | B2 | 4/2010 | Bennett | |
| 7,707,690 | B2 | 5/2010 | Lowry et al. | |
| 2006/0112520 | A1 | 6/2006 | Markl et al. | |
| 2007/0234517 | A1 * | 10/2007 | Larson et al. | 16/342 |
| 2007/0283534 | A1 * | 12/2007 | Chang et al. | 16/342 |
| 2010/0018004 | A1 | 1/2010 | Ochiai et al. | |
| 2010/0139044 | A1 * | 6/2010 | Minegishi | 16/333 |

OTHER PUBLICATIONS

Drawings of a product made by Southco, Inc., incorporating friction hinges. (File name: hinge_2.pdf.).

Drawings of a product made by Southco, Inc., incorporating friction hinges with springs. (File name: hinge_3.pdf.).

* cited by examiner

DETENT HINGE

CROSS REFERENCE TO RELATED APPLICATIONS

This application claims the priority of U.S. Provisional Application for Patent Ser. No. 61/429,114, filed on Jan. 1, 2011, which is incorporated herein by reference in its entirety.

BACKGROUND OF THE INVENTION

1. Field of the Invention

The present invention relates to a hinge assembly for rotationally attaching a first member to a second member to allow rotational movement of the first member relative to the second member that provides for increased resistance to relative rotation between the first member and the second member at one or more predetermined angular positions of the first member relative to the second member.

2. Description of the Prior Art

Hinge assemblies for rotationally attaching a first member to a second member to allow rotational movement of the first member relative to the second member are known in the prior art. Furthermore, hinge assemblies that provide for increased resistance to relative rotation between the first member and the second member at one or more predetermined angular positions of the first member relative to the second member are also known in the prior art. Examples of such hinge assemblies, known in the art as detent hinges, can be seen in U.S. Pat. No. 5,412,842 issued to Allen Riblett, on May 9, 1995, U.S. Pat. No. 6,941,617 B2 issued to Ana Christina Pinto, on Sep. 13, 2005, U.S. Pat. No. 7,320,152 B2 issued to David A. Lowry et al., on Jan. 22, 2008, U.S. Pat. No. 6,141,831 issued to Eugene Novin et al., on Nov. 7, 2000, U.S. Pat. No. 7,065,834 B2 issued to David A. Lowry, on Jun. 27, 2006, and U.S. Pat. No. US 5,765,263 issued to Andres A. Bolinas et al., on Jun. 16, 1998.

In general, hinges have a first hinge part adapted for attachment to a first hinged member and a second hinge part adapted for attachment to a second hinged member. A hinge shaft supports the first and second hinge parts for rotation relative to one another, which in turn provides for relative rotation between the first and second hinged members. The phrase "hinged members" refers to the first and second members that are connected together using the hinge such that they can rotate or pivot relative to one another. Detent hinges have an additional function that provides for increased resistance to relative rotation between the first hinge part and the second hinge part at one or more predetermined angular positions of the first hinge part relative to the second hinge part in order to provide for the holding of the first hinged member at one or more desired angular positions relative to the second hinged member. This additional function is what is referred to as the detent function of the hinge.

U.S. Pat. Nos. 5,412,842 and 6,941,617 B2 show detent hinges that use coil springs that are positioned to extend transversely relative to the longitudinal axis of the hinge shaft to bias members such as ball bearings into engagement with grooves in the hinge shaft in order to provide for the detent function of the hinge. The space needed for the coil springs which extend laterally relative to the hinge shaft prevents these prior art hinges from being compact enough for certain applications.

U.S. Pat. Nos. 7,320,152 B2, 6,141,831, and 7,065,834 B2 show detent hinges that use coil springs that fit around the hinge shaft and that extend longitudinally along the hinge shaft. The spring biases a cam that can slide back and forth along a direction coincident with the longitudinal axis of the hinge shaft. The cam is prevented from rotation relative to one of the first and second hinge parts, which for the sake of convenience we will designate the second hinge part. Usually this would be the hinge part that houses the spring. The cam has one or more protrusions that engage corresponding depressions provided in the other hinge part, which in this case would be the first hinge part, in order to provide for the detent function of the hinge. This type of detent hinge can be made in a very compact size; however, this type of detent hinge has the disadvantage that its parts are exposed to sliding friction, which can cause faster wear as compared to the ware due to the rolling friction of the ball bearings in the previous type of prior art detent hinge.

U.S. Pat. No. 5,765,263 shows a third type of prior art detent hinge. In this type of hinge, a member is biased to project radially outward from the hinge shaft. The hinge shaft is fixed to the second hinge part and extends into a bore in the first hinge part such that the first hinge part can rotate on the hinge shaft. The member projecting radially from the shaft engages one or more grooves in the bore of the first hinge part in order to provide for the detent function of the hinge. This type of detent hinge cannot be made compact enough for some applications because the hinge shaft must be large enough in size, both in terms of diameter and length, to house the radially projecting member. This type of detent hinge has the additional disadvantage that its parts are exposed to sliding friction, which can cause faster wear as compared to the ware due to the rolling friction of the ball bearings used in the first type of prior art detent hinge.

None of the prior art hinge assemblies are seen to teach or suggest the unique features of the present invention or to achieve the advantages of the present invention.

SUMMARY OF THE INVENTION

The present invention is directed to a hinge assembly for rotationally attaching a first member to a second member to allow rotational movement of the first member relative to the second member. The hinge assembly of the present invention includes a spring that biases one or more needle rollers, also known as needle bearings, into engagement with the outer surface of the hinge shaft. The needle rollers engage one or more grooves in the surface of the hinge shaft to provide the detent function of the hinge. The spring is in the form of a resilient band that surrounds at least a portion of the circumference of a cross section of the hinge shaft. The resilient band may be curved with the center of curvature approximately coincident with the central longitudinal axis of the hinge shaft. The spring is provided with a depression that faces the surface of the hinge shaft and that receives a portion of the needle roller. The spring that biases the needle roller into engagement with the surface of the hinge shaft, hence forth referred to as the detent spring, is expanded outward from its relaxed state in order to fit around the shaft and needle roller, especially when the needle roller is out of the grooves in the surface of the hinge shaft, such that the detent spring exerts a force on the needle roller that acts to press the needle roller against the surface of the hinge shaft. The force exerted by the detent spring on the needle roller generates a force between the needle roller and the surface of the hinge shaft that is generally directed radially toward the central longitudinal axis of the hinge shaft. The detent spring presses the needle roller against the surface of the hinge shaft with some force at least when the needle bearing is not positioned in any of the grooves in the surface of the hinge shaft and more preferably it does so at all times. The needle roller can roll on the surface of the hinge shaft as the hinge shaft is rotated relative to the spring.

The hinge shaft is fixed to the first hinge part such that the hinge shaft rotates with the first hinge part as a unit and in turn with the first hinged member when the first hinge part is secured to the first hinged member. The hinge shaft is supported by the second hinge part for rotational movement relative to the second hinge part. The detent spring is housed in the second hinge part and is prevented from rotating relative to the second hinge part. Accordingly, the detent hinge assembly is provided with means to prevent the rotation of the detent spring relative to the second hinge part.

The hinge assembly also includes a friction mechanism that exerts a sufficient frictional force on the hinge shaft such that the inadvertent movement of the first hinged member relative to the second hinged member is resisted even when the first hinged member is not in any of its detent positions relative to the second hinged member. The detent position of the first hinged member or of the first hinge part corresponds to an angular position of the first hinged member or the first hinge part, respectively, relative to the second hinge part, and in turn relative to the second hinged member, at which one or more of the needle rollers is engaging a groove in the surface of the hinge shaft. None of the prior art teach or suggest the unique detent spring of the present invention. In addition, none of the prior art teach or suggest the use of needle rollers in a detent hinge.

The detent mechanism of the detent hinge refers to that portion of the hinge assembly responsible for providing the increased resistance to relative rotation between the first and second hinge parts when the first and second hinge parts are at one or more of the predetermined angular positions relative to one another corresponding to their detent positions. The increased resistance to relative rotation of the first and second hinge parts in the detent position is gauged relative to the resistance to relative rotation between the first and second hinge parts when they are not in their detent positions.

Accordingly, it is an object of the invention to provide a detent hinge that is compact in size.

It is another object of the invention to provide a detent hinge that employs rolling friction in the detent mechanism.

It is yet another object of the invention to provide a detent hinge that employs a friction mechanism in addition to the detent mechanism that provides a predetermined resistance to the relative rotation of the first and second hinge parts even when the first and second hinge parts are not in a detent position relative to one another.

It is yet another object of the invention to provide a detent hinge that employs a detent mechanism including a detent spring in the form of a band that wraps around at least a portion of the perimeter of a transverse section of the hinge shaft.

It is yet another object of the invention to provide a detent hinge that employs a detent mechanism including at least one needle roller that engages a groove in the hinge shaft when the first and second hinge parts are in a detent position relative to one another.

It is yet another object of the invention to provide a detent hinge that employs a detent mechanism including a detent spring in the form of a band that wraps around at least a portion of the perimeter of a transverse section of the hinge shaft and at least one needle roller biased by the detent spring to engage a groove in the hinge shaft when the first and second hinge parts are in a detent position relative to one another.

These and other objects and advantages of the present invention will become apparent from the description and drawings that follow.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
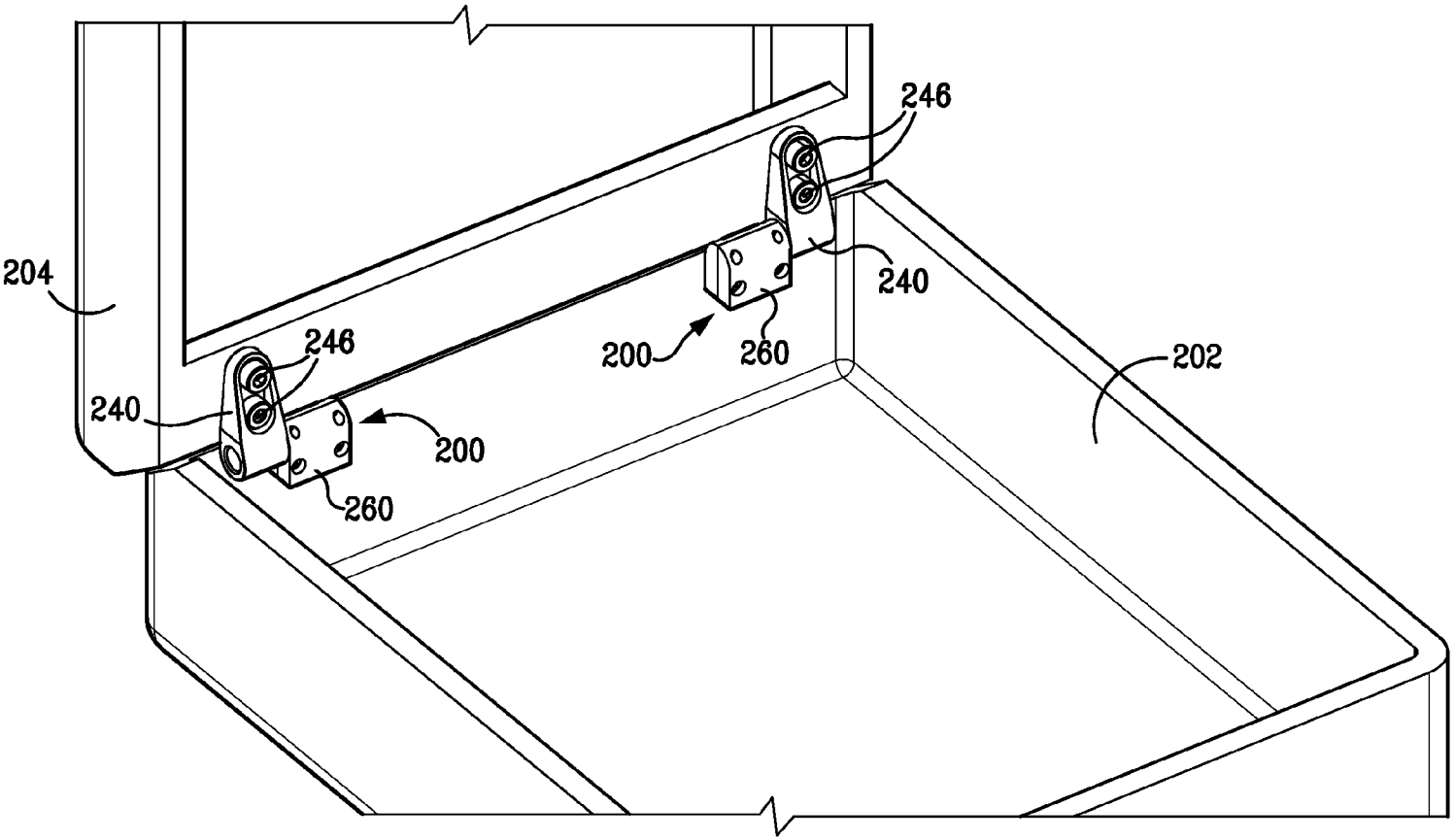
FIGS. 1-4 are environmental views of the hinge assembly of the present invention.
Figure 2:
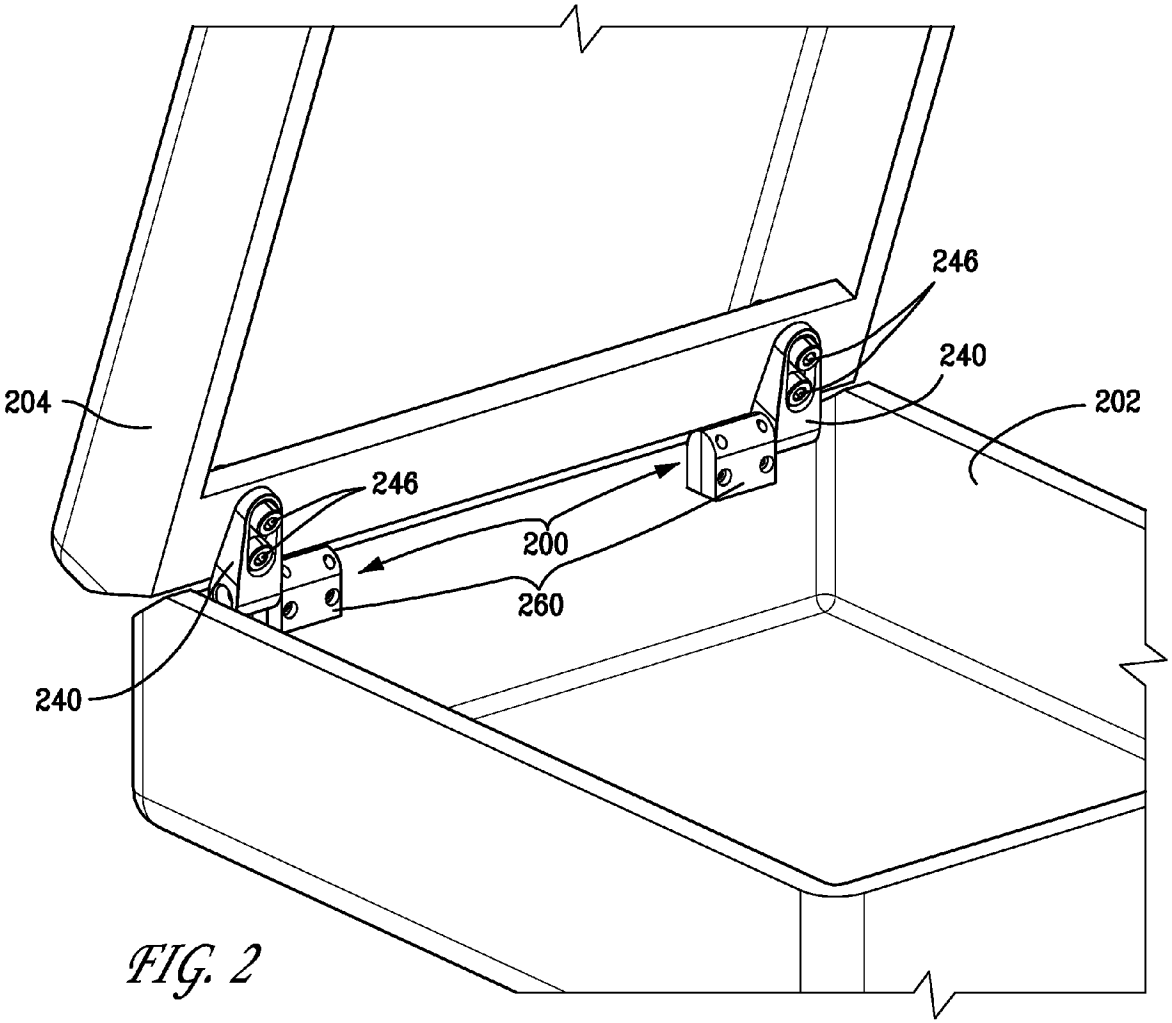
Figure 3:
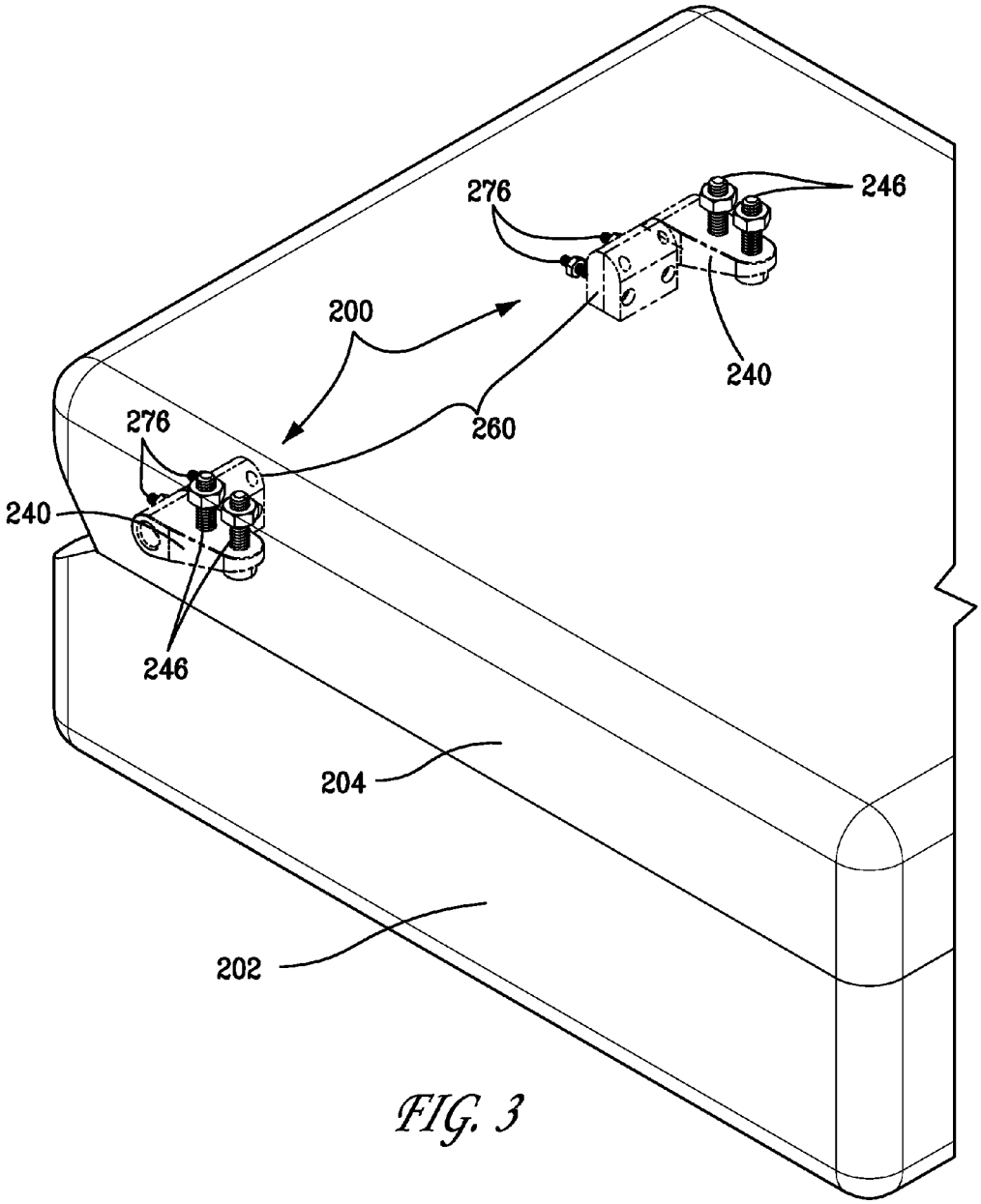
Figure 4:
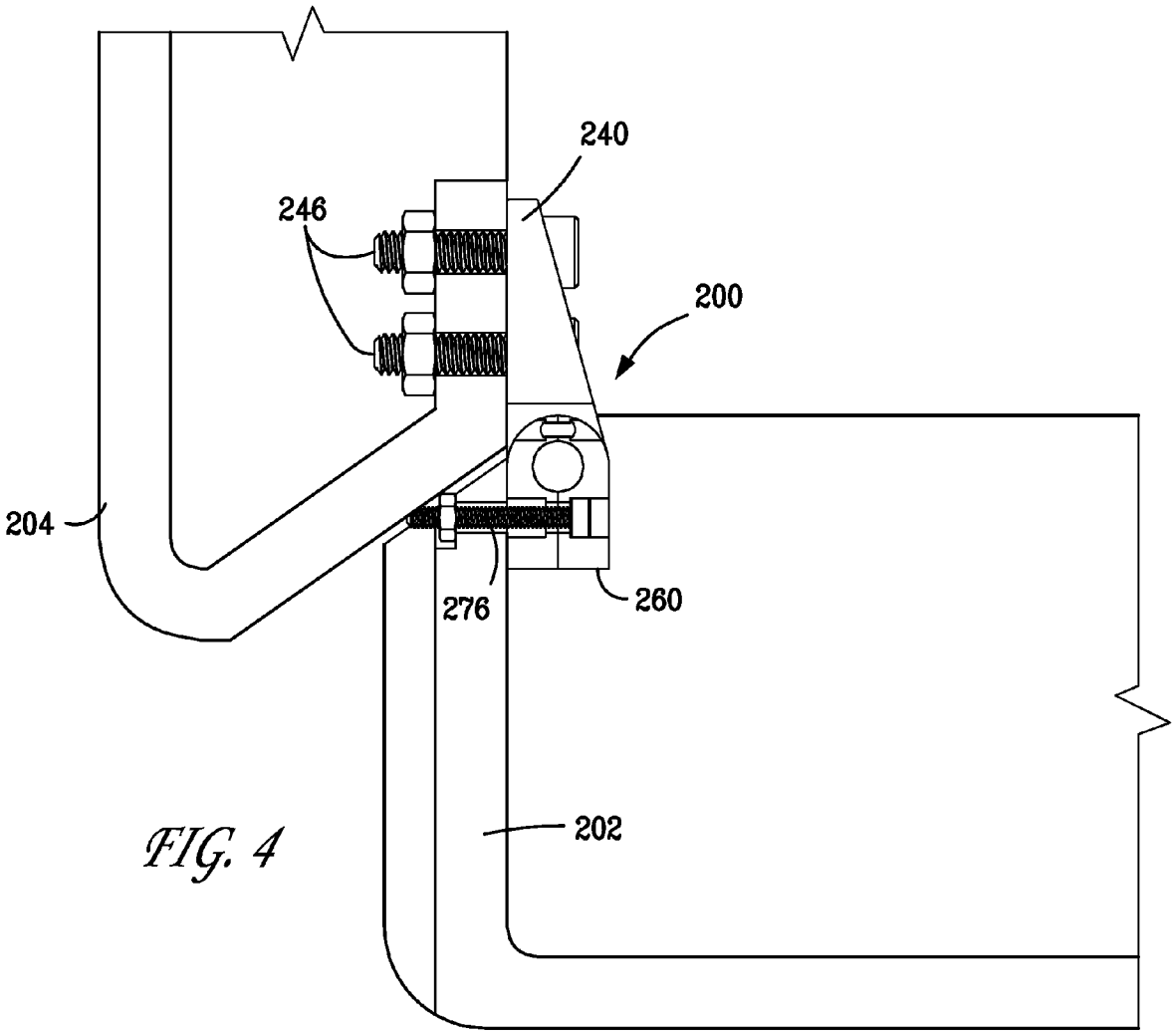
Figure 5:
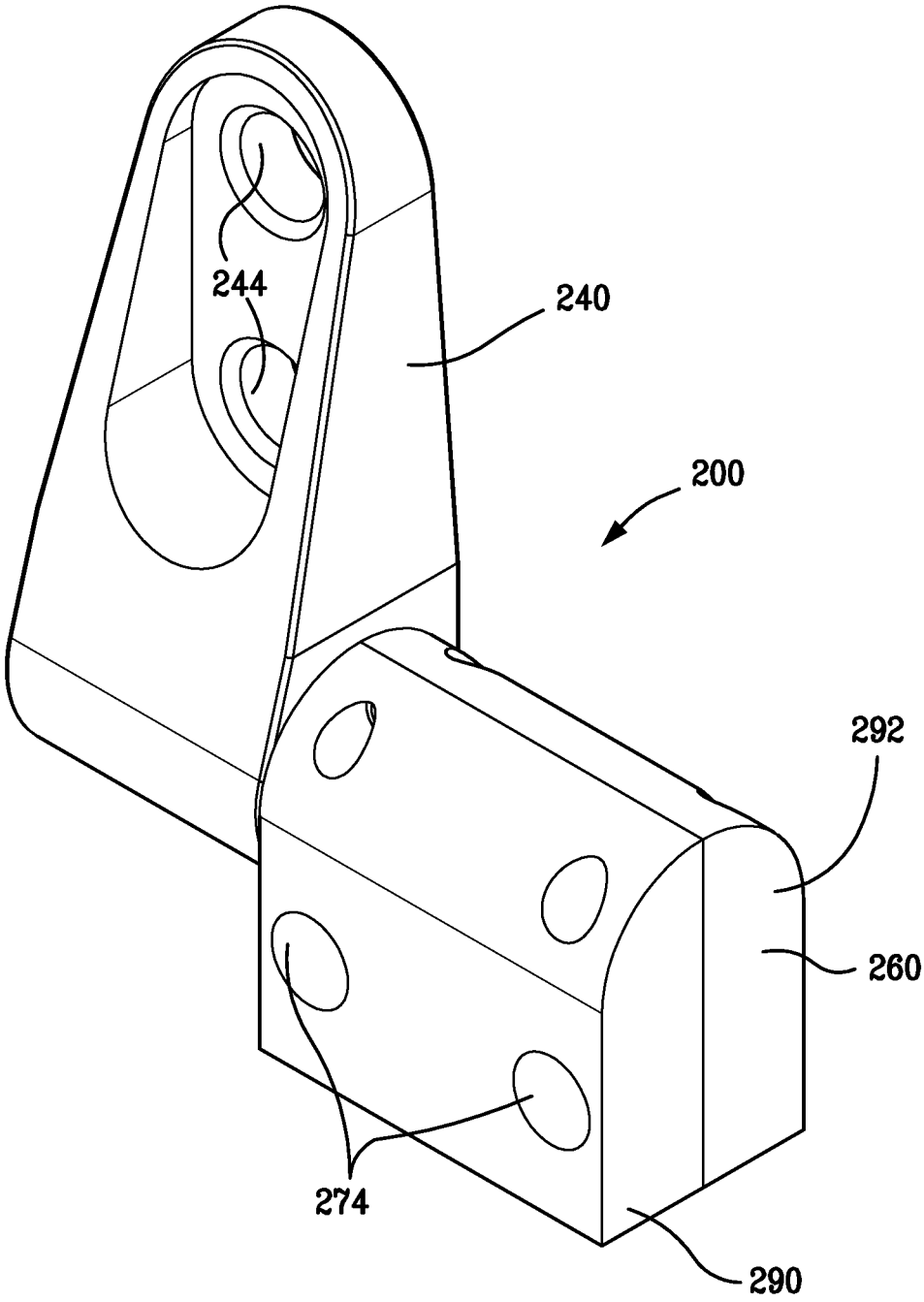
FIGS. 5-11 are views of the hinge assembly of the present invention.
Figure 6:
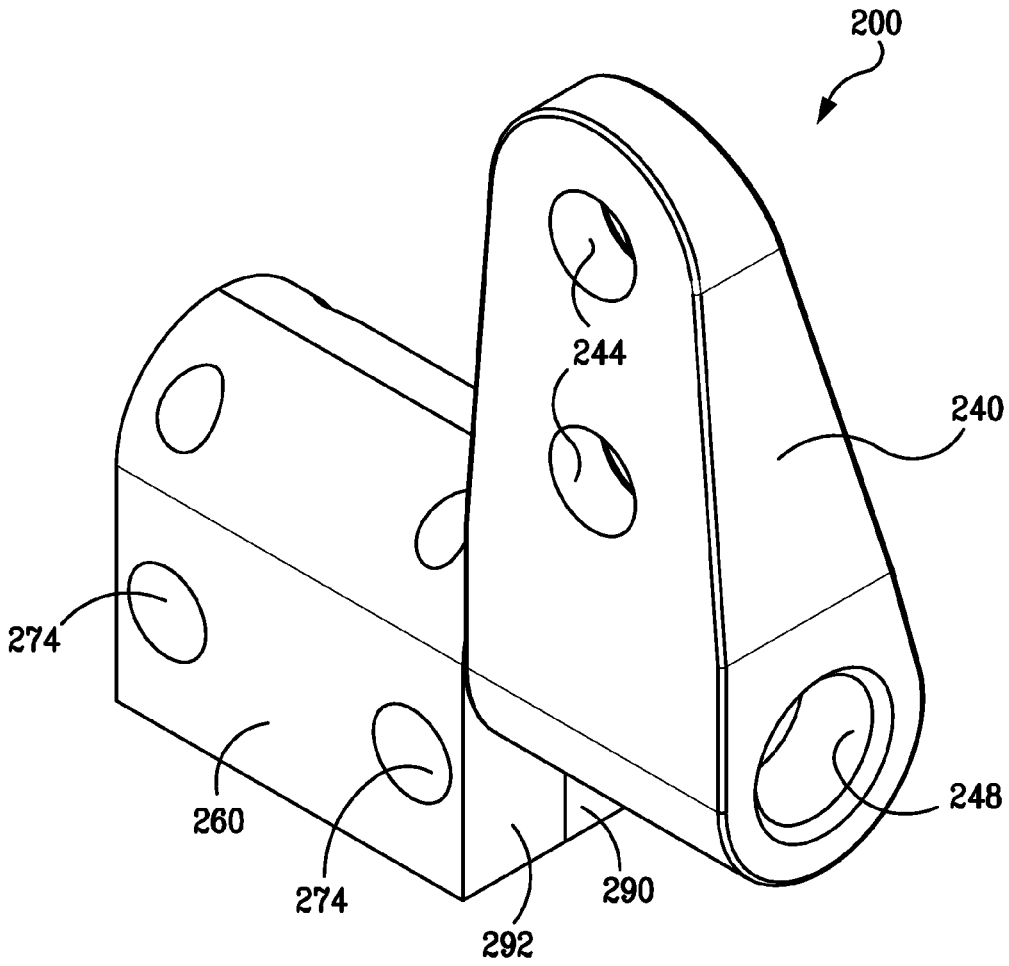
Figure 8:
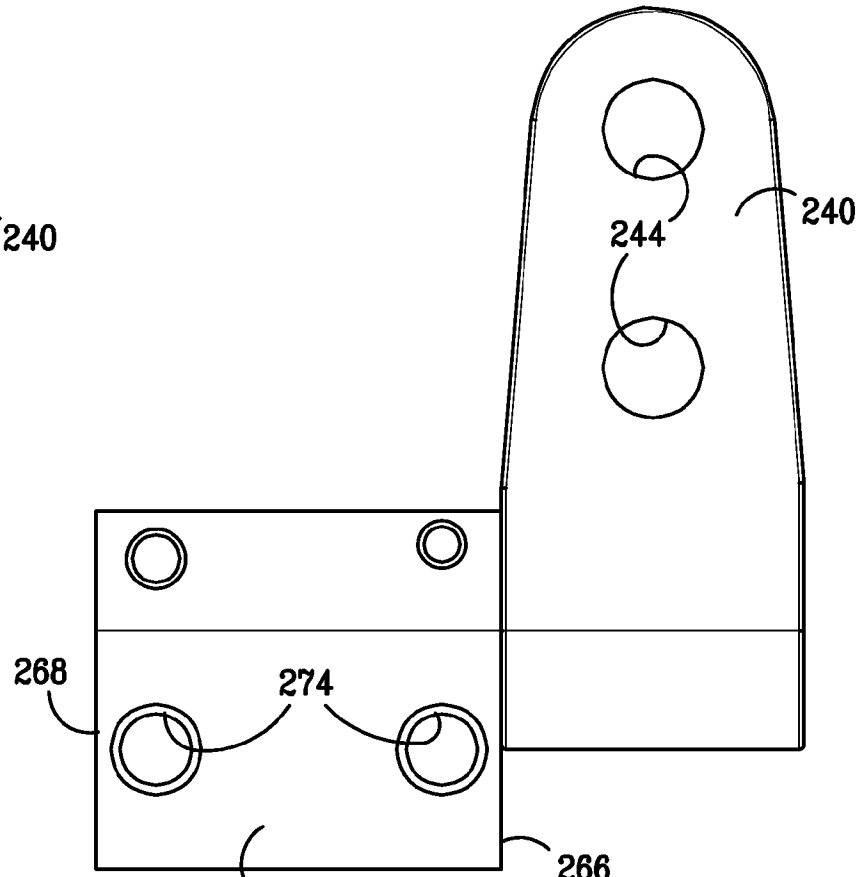
Figure 7:
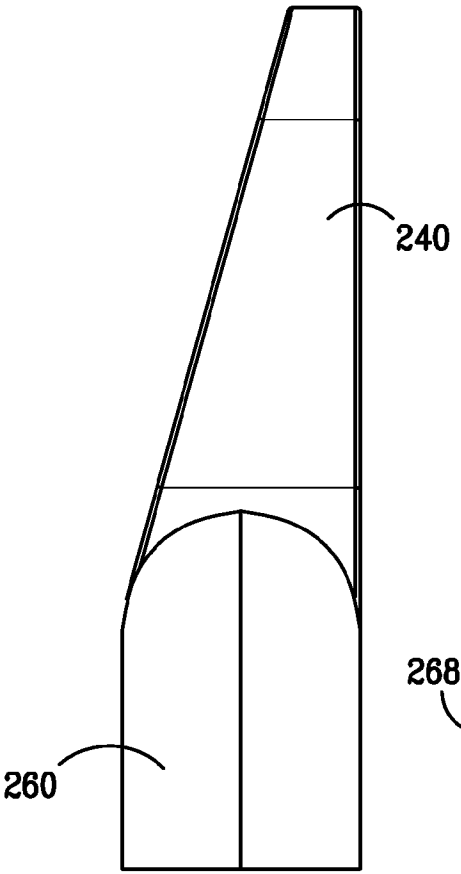
Figure 10:
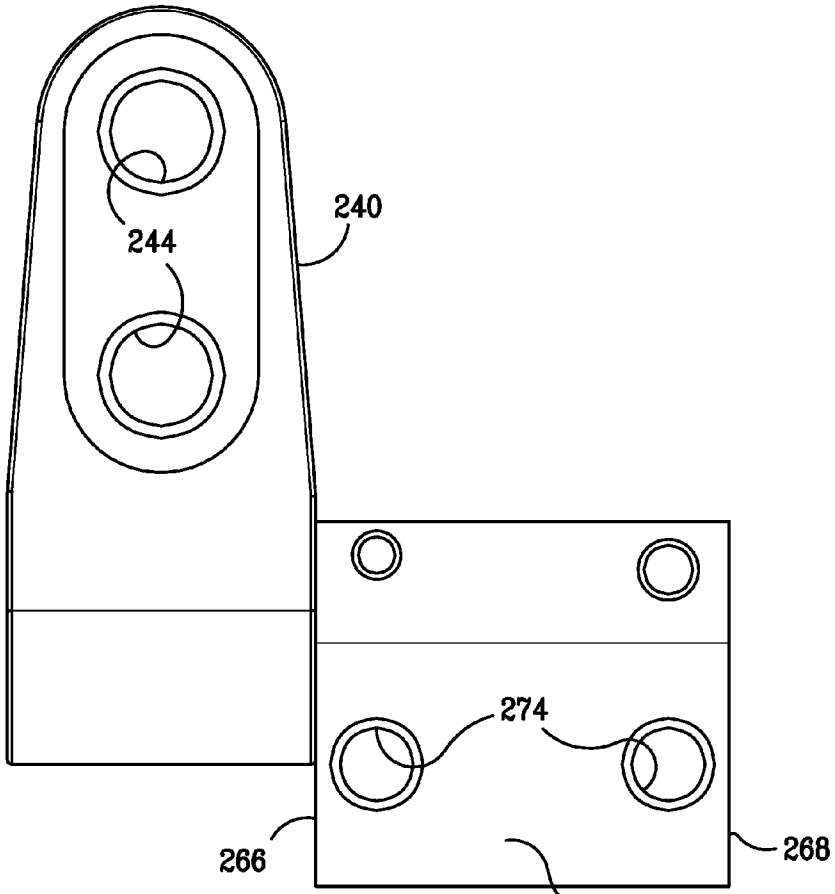
Figure 9:
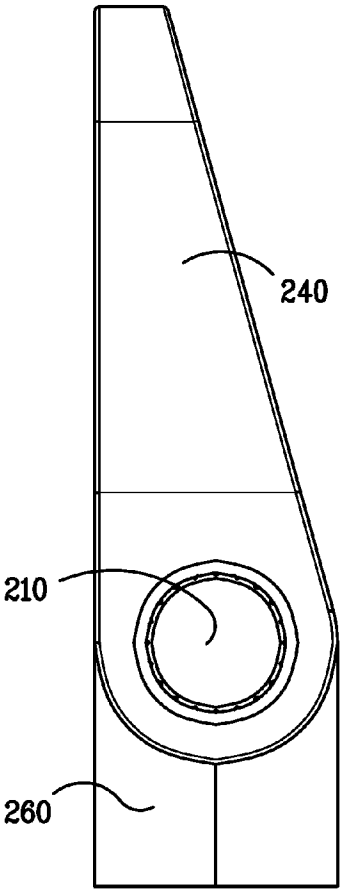
Figure 11:
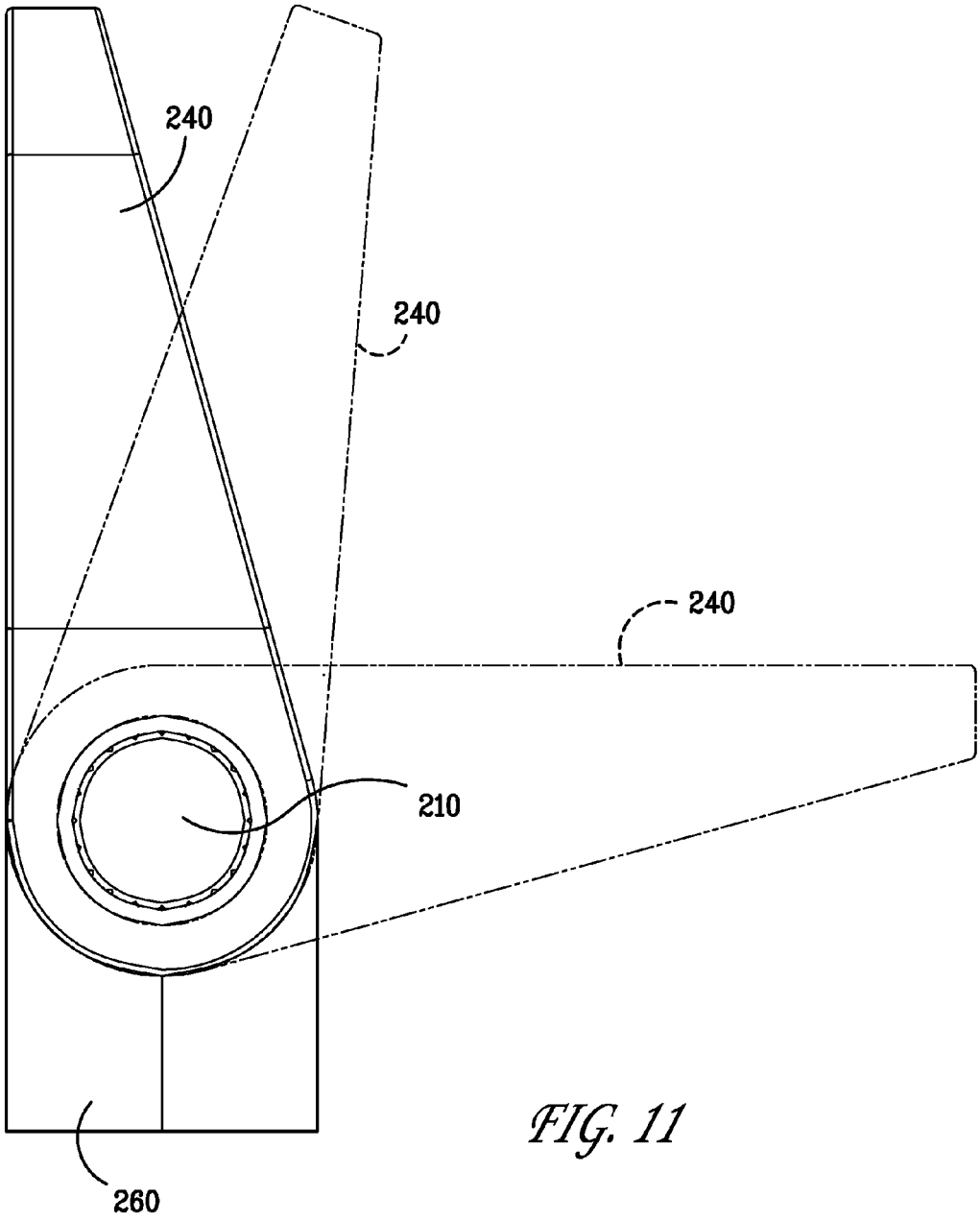
Figure 12A:
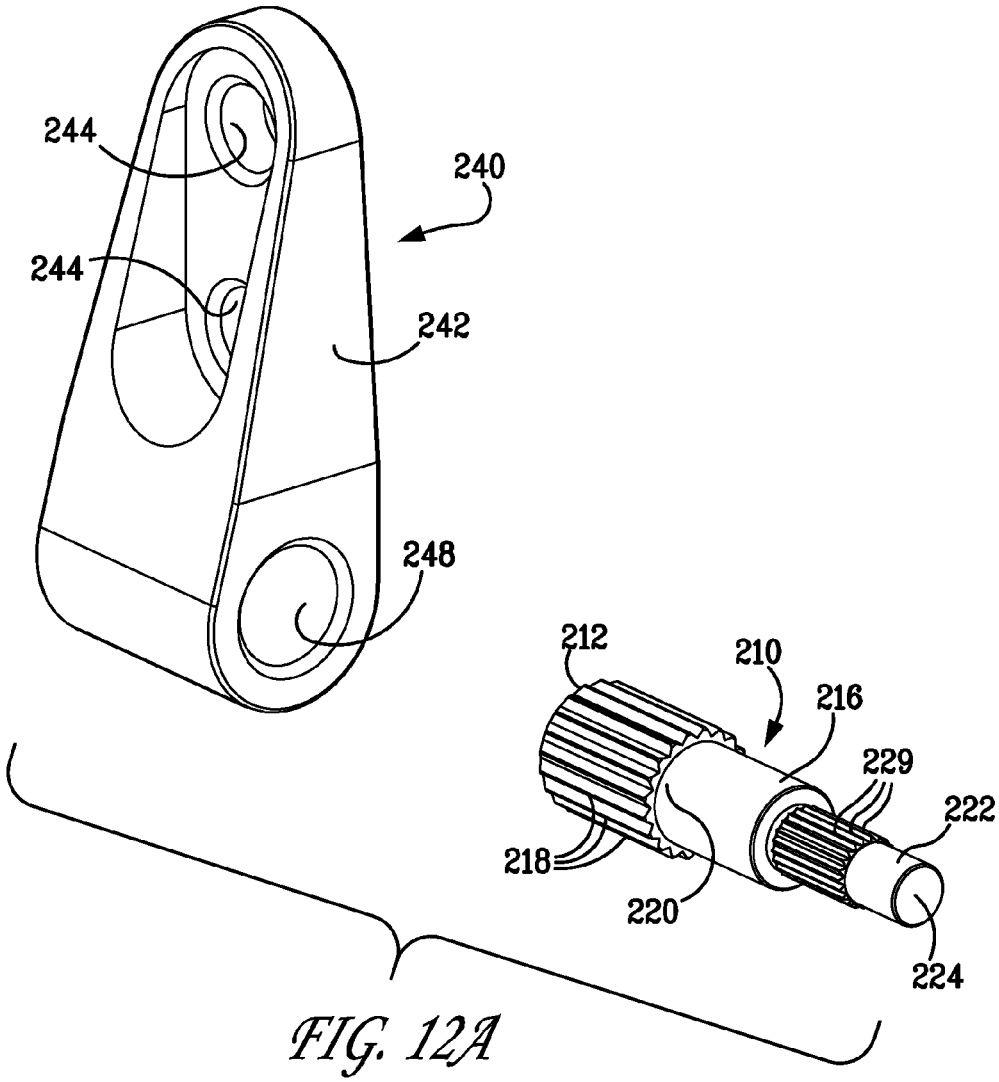
FIGS. 12A-12B are exploded views of the hinge assembly of the present invention.
Figure 12B:
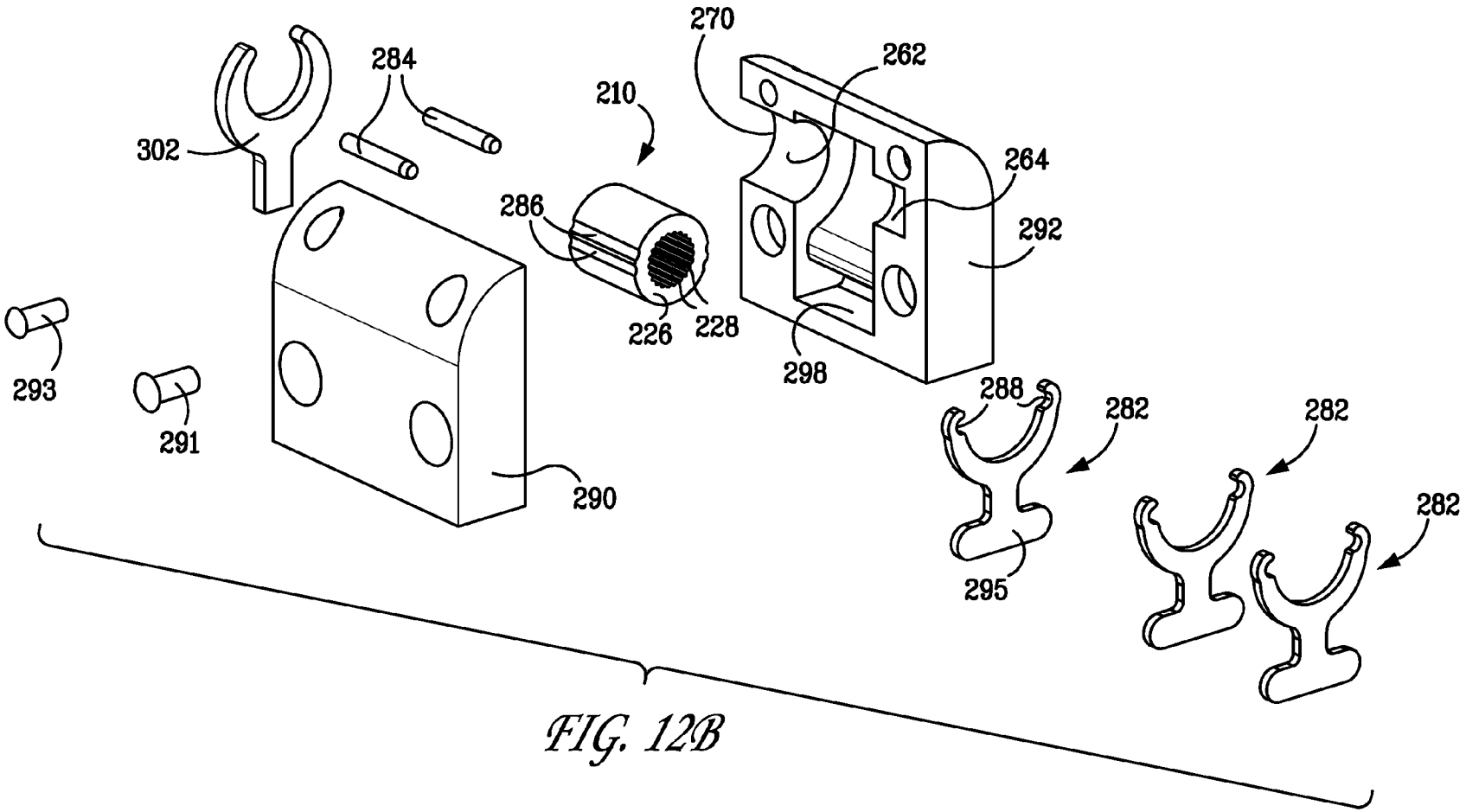
Figure 13:
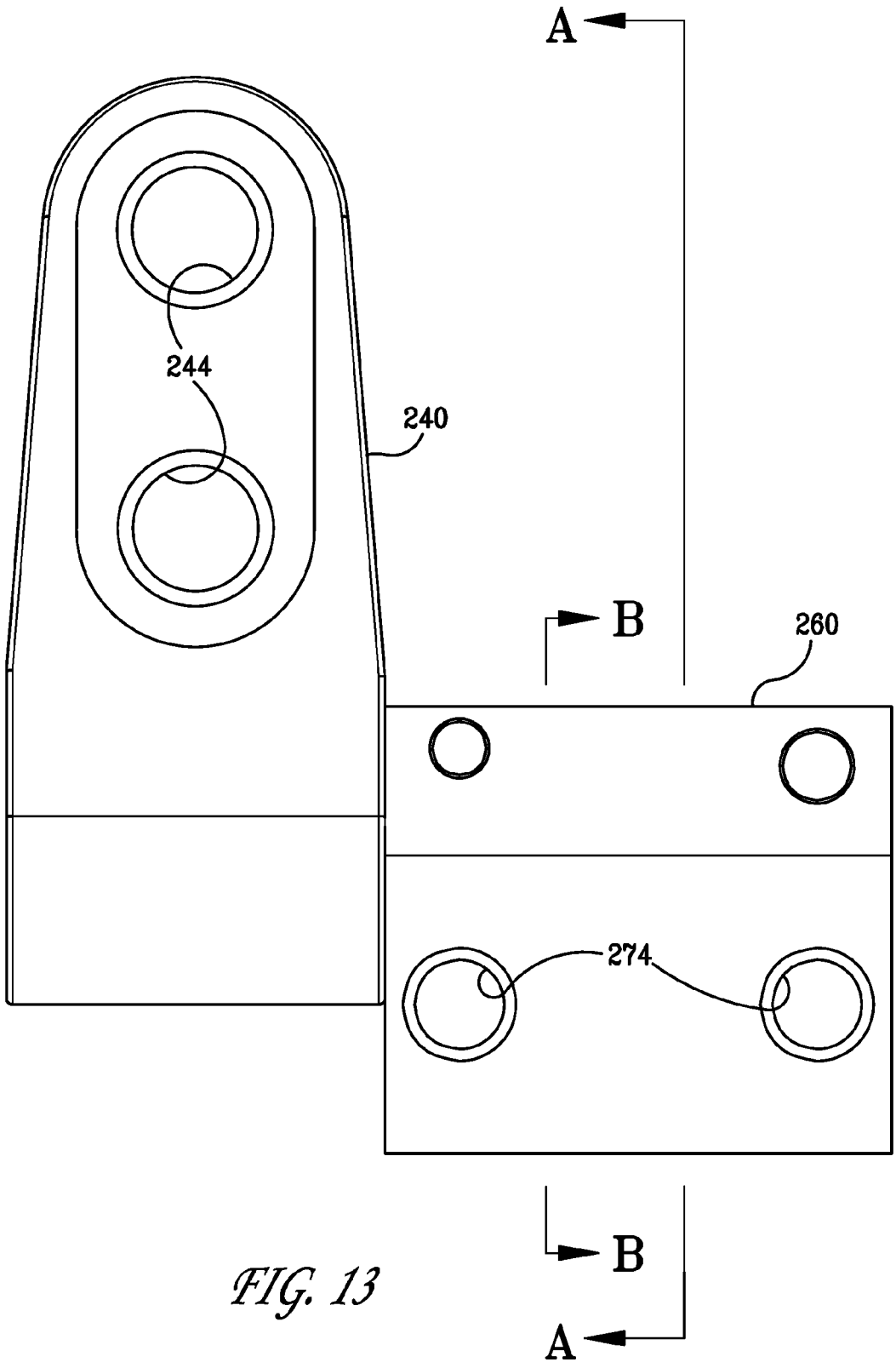
FIG. 13 is a guide view showing the cut lines for sections A-A and B-B.
Figure 14:
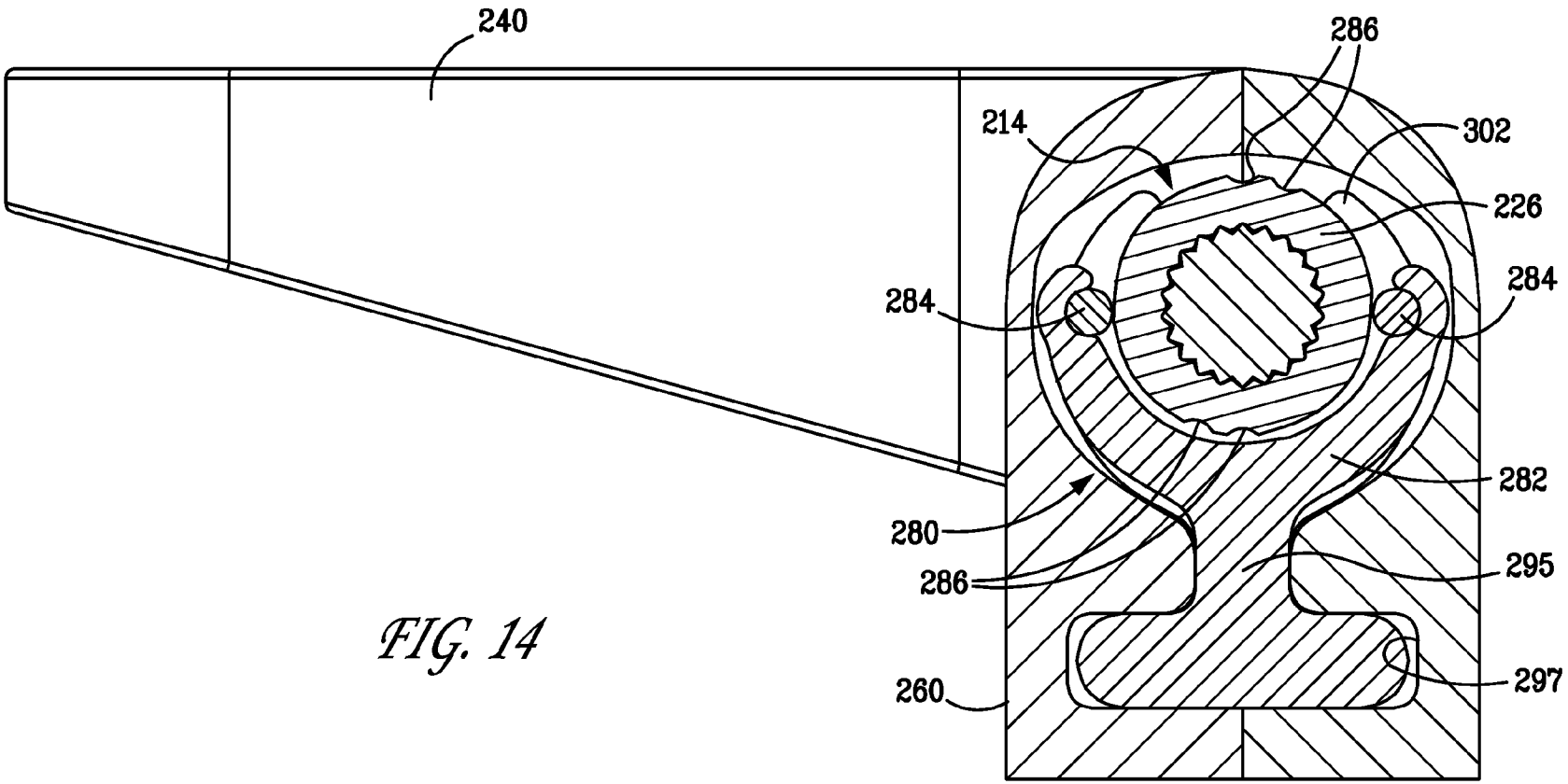
FIGS. 14-16 are cross sectional views along cut line A-A.
Figure 15:
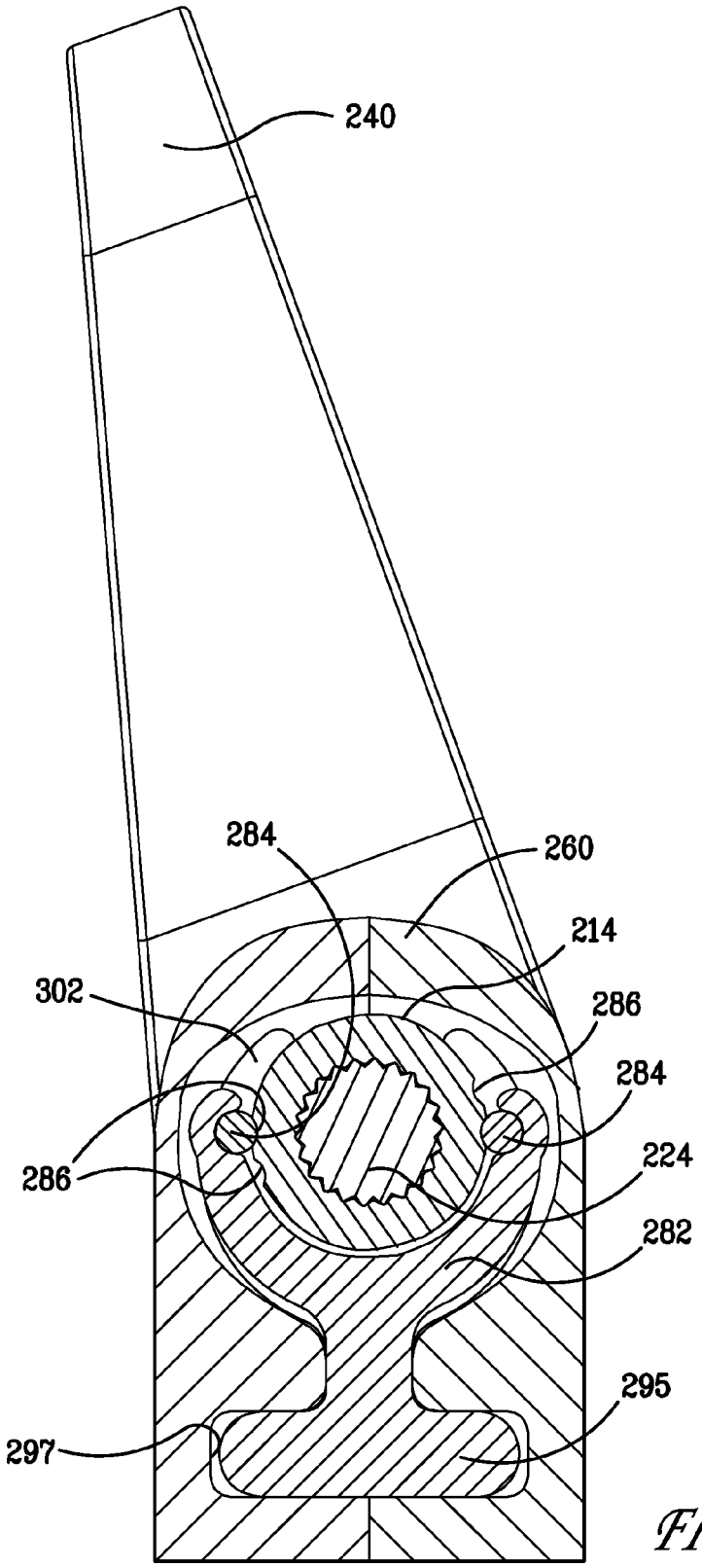
Figure 16:
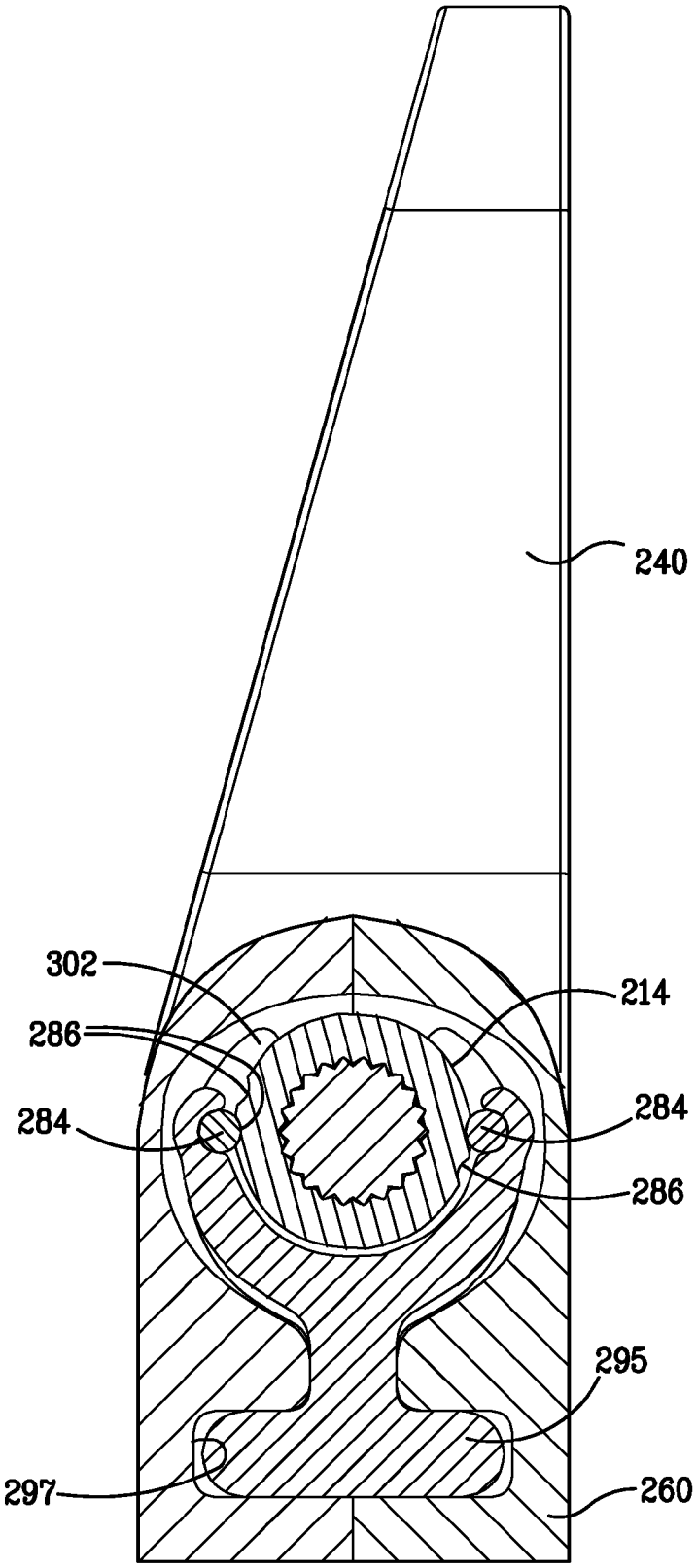
Figure 17:
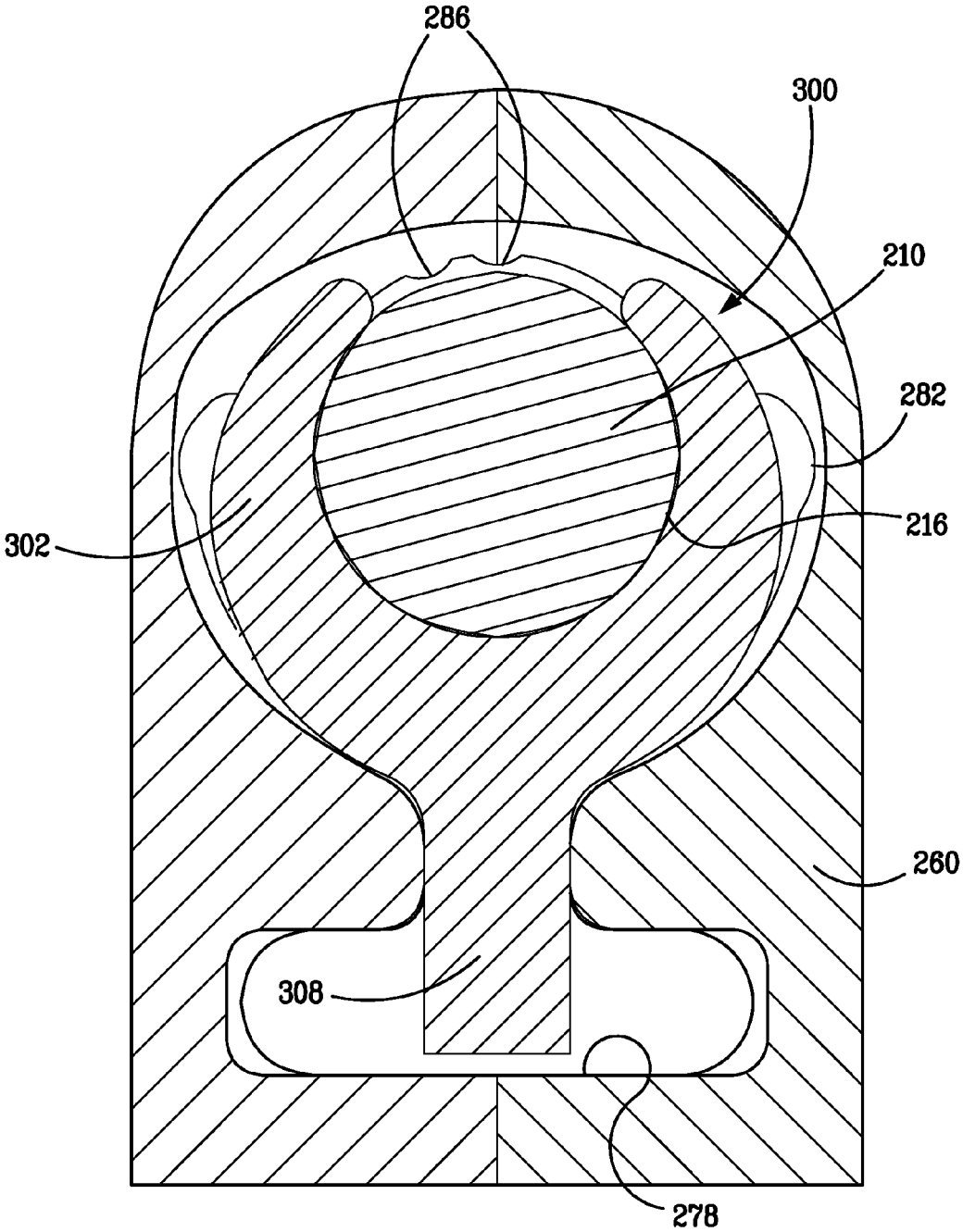
FIGS. 17-18 are cross sectional views along cut line B-B.
Figure 18:
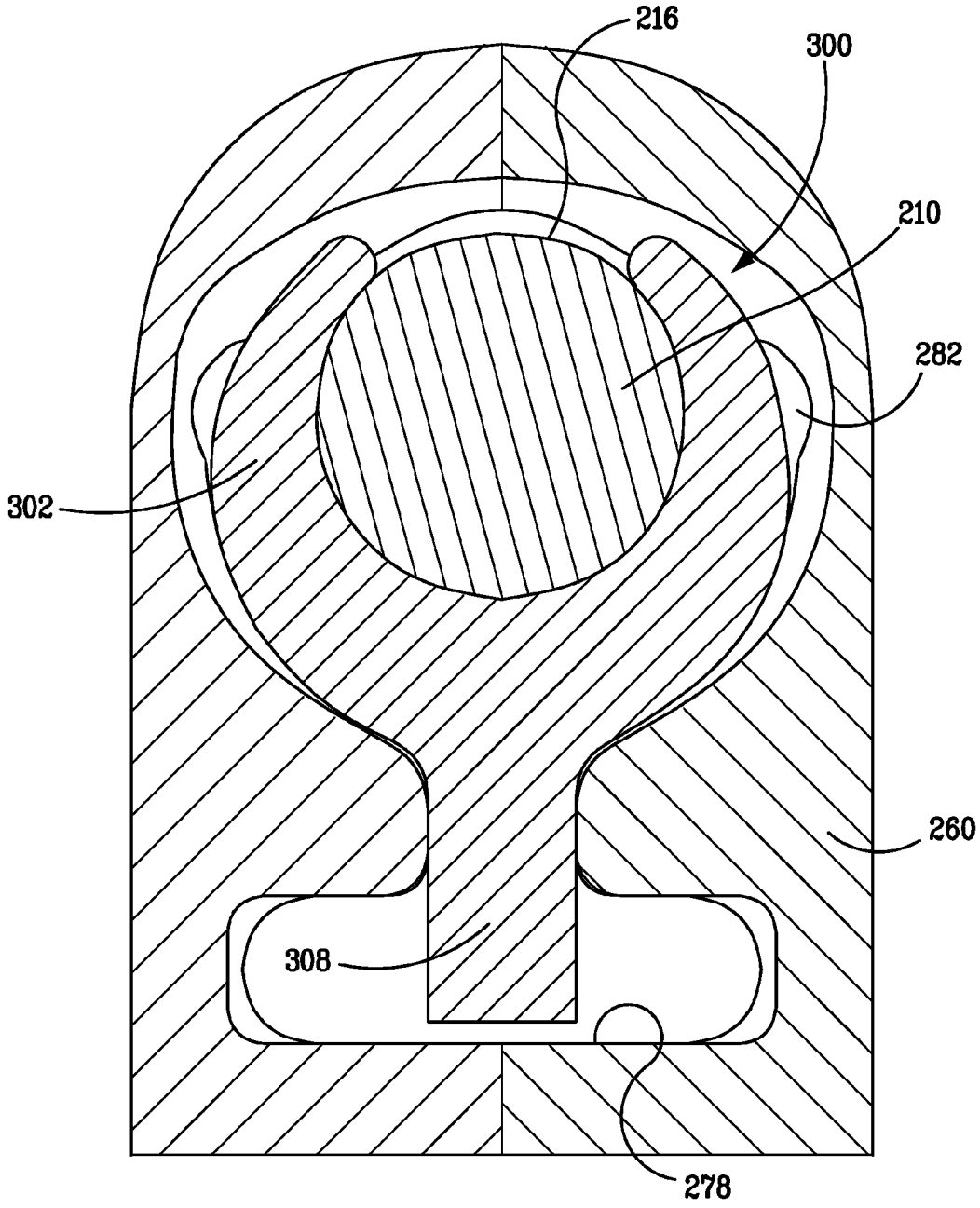
Figure 19:
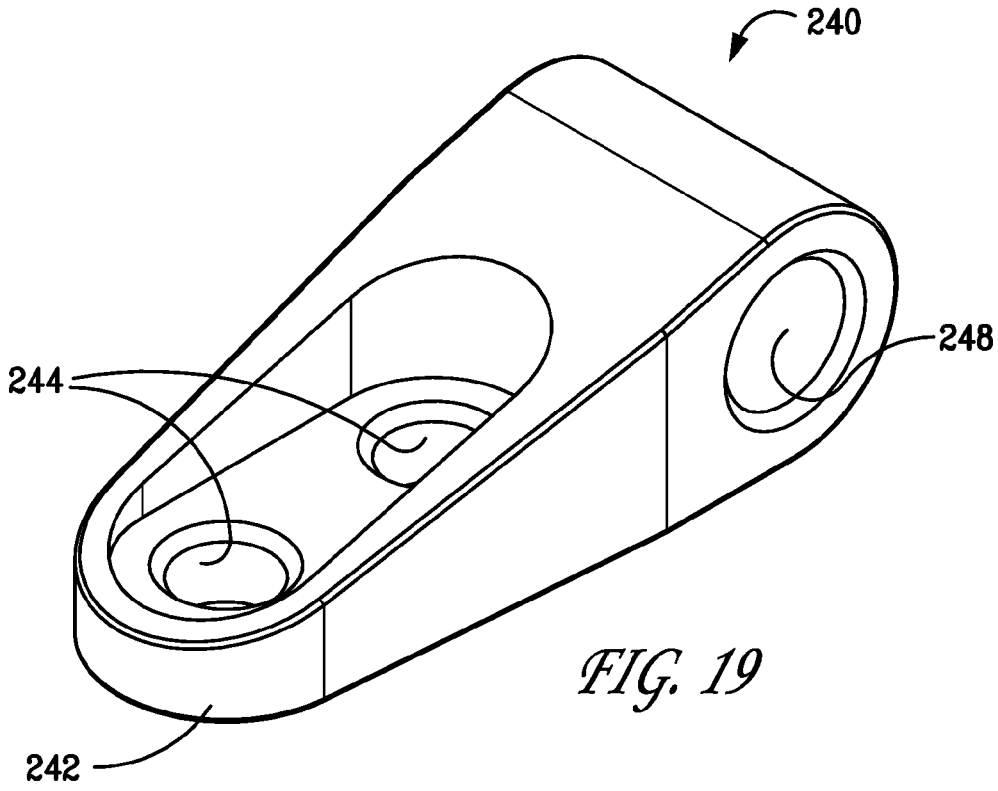
FIGS. 19-23 are views of the adaptor of the hinge assembly of the present invention.
Figure 20:
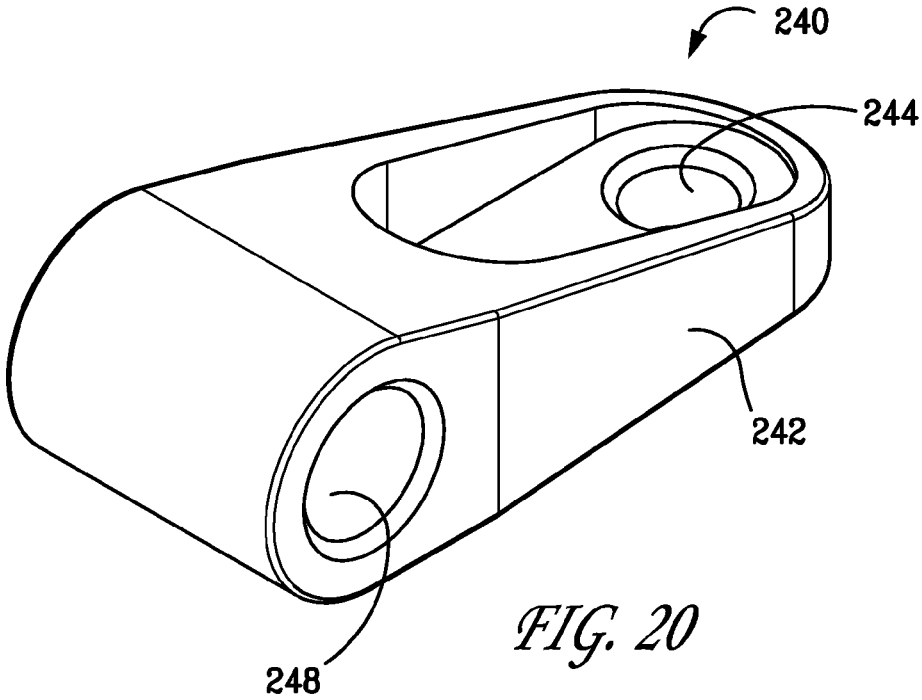
Figure 21:
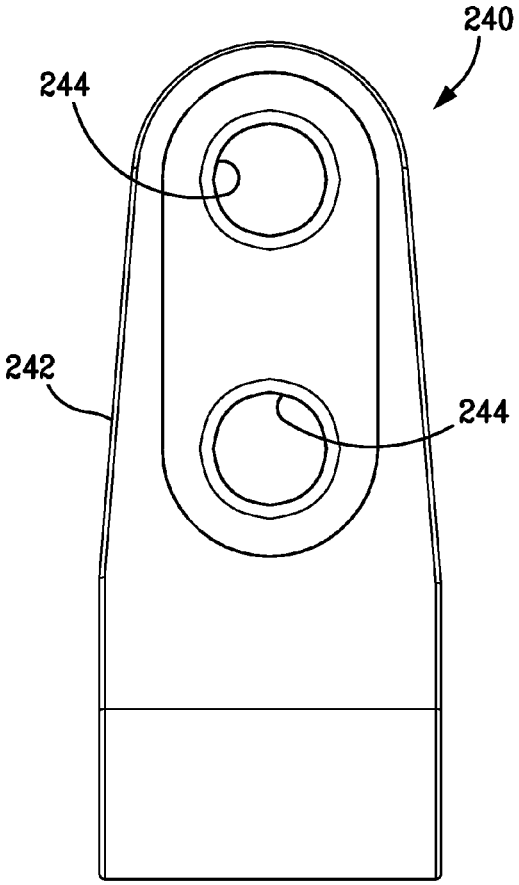
Figure 22:
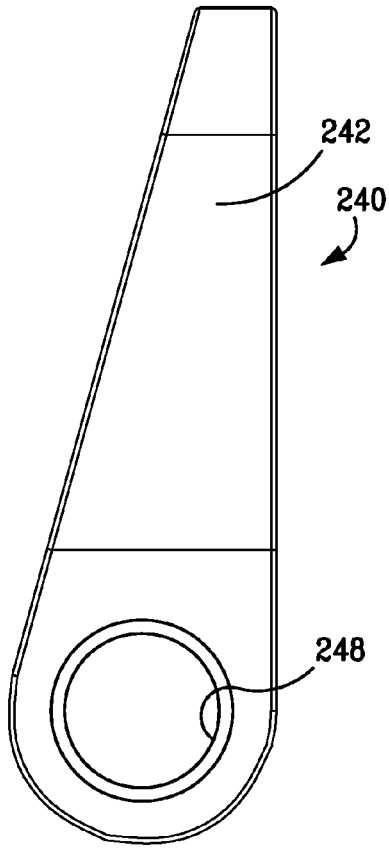
Figure 23:
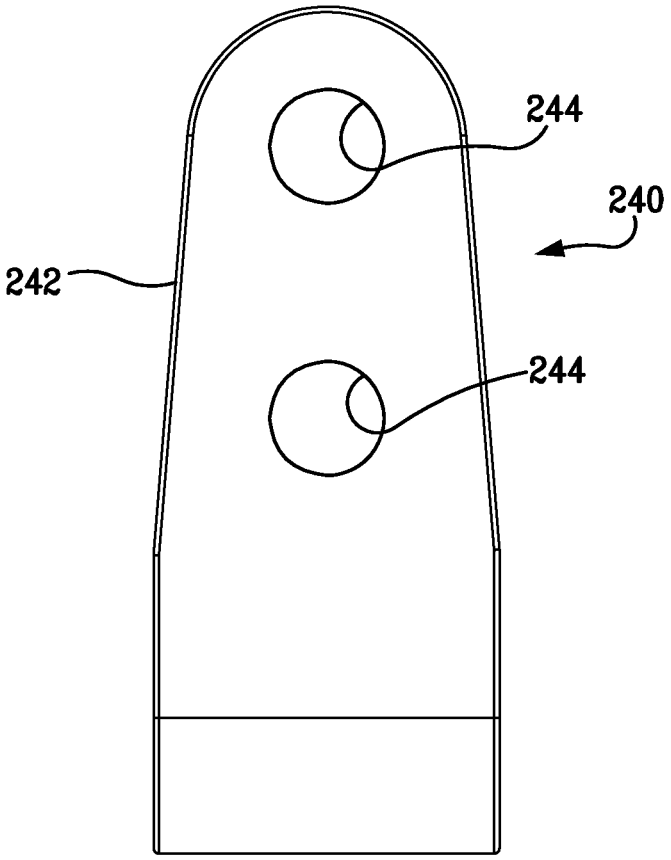
Figure 25:
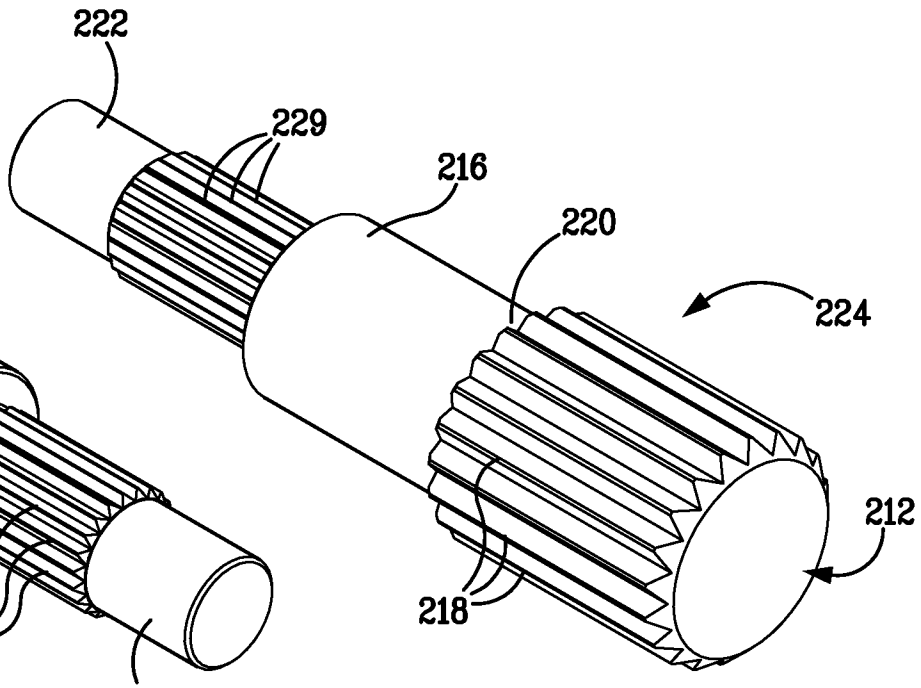
FIGS. 24-26 are views of the hinge shaft portion of the hinge assembly of the present invention.
Figure 24:
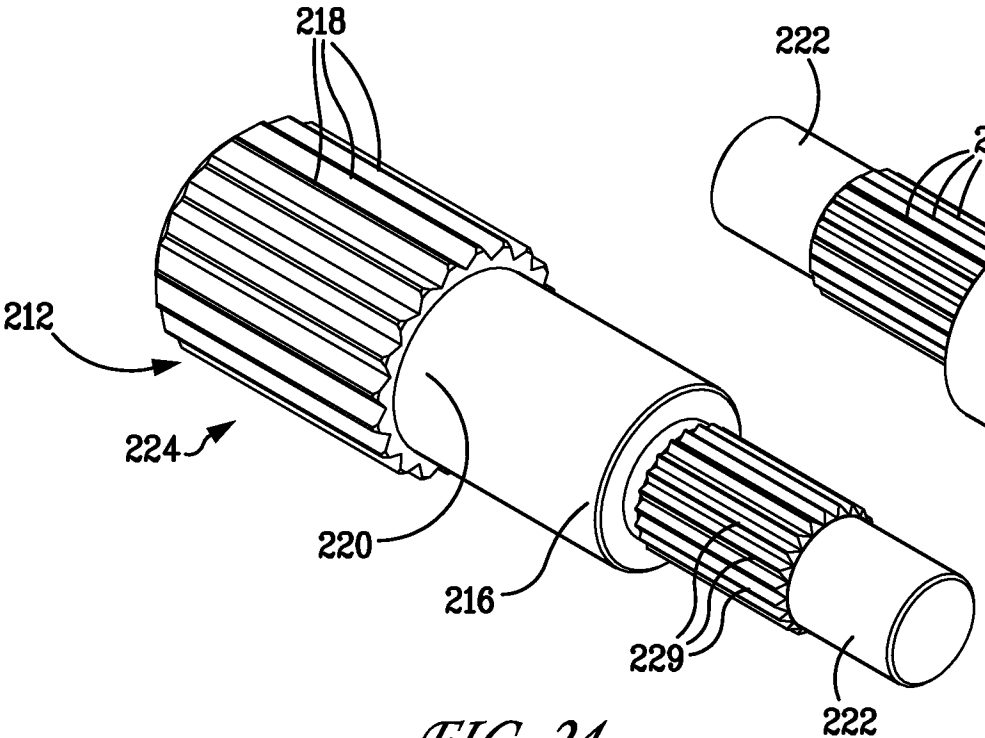
Figure 26:
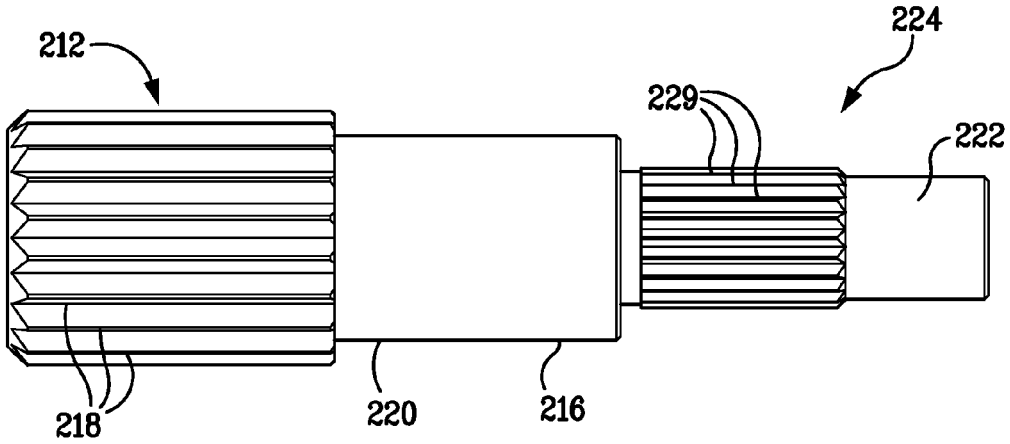
Figure 27:
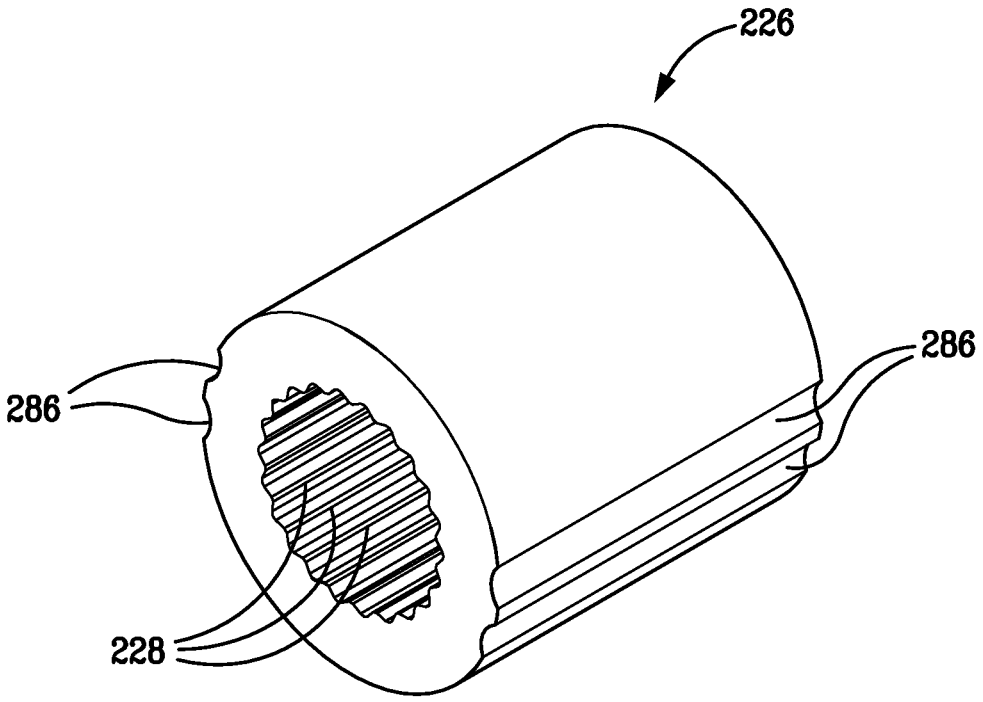
FIGS. 27-29 are views of the hinge shaft sleeve portion of the hinge assembly of the present invention.
Figure 28:
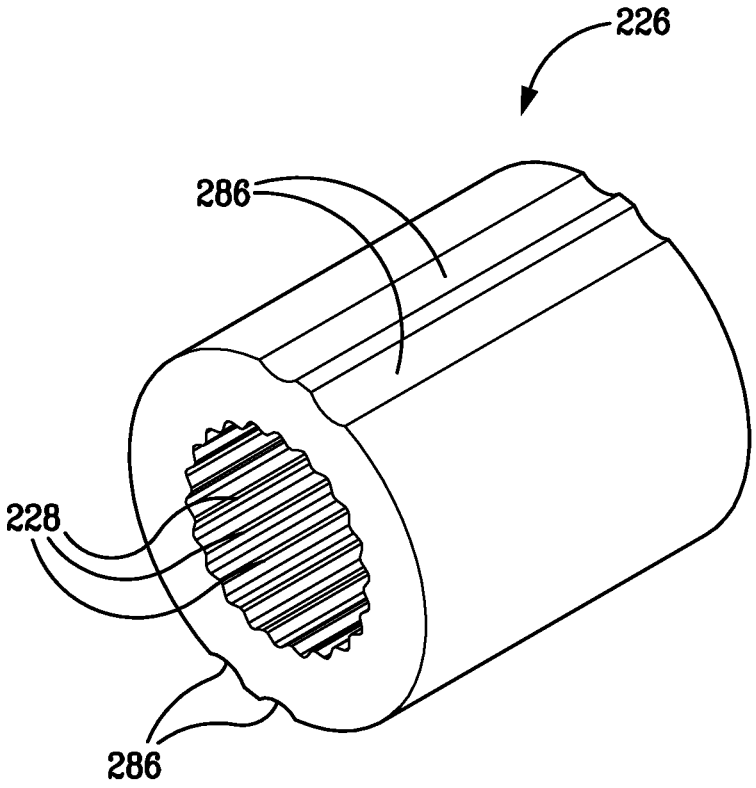
Figure 29:
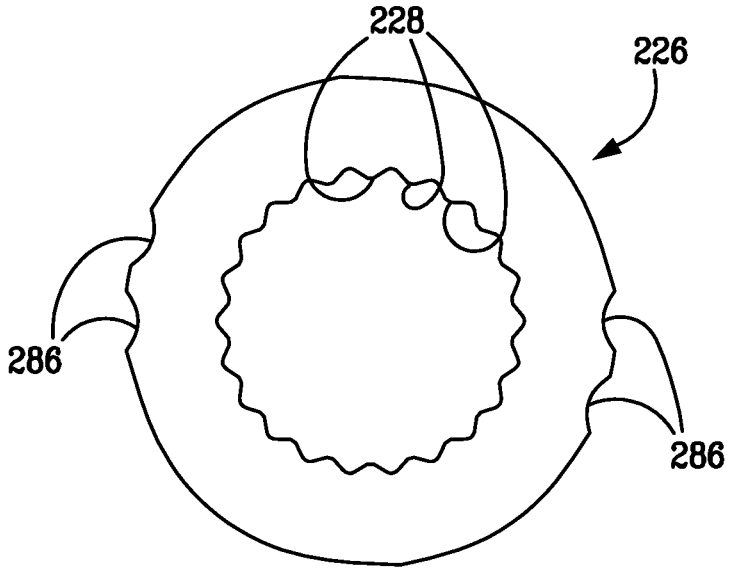
Figure 30:
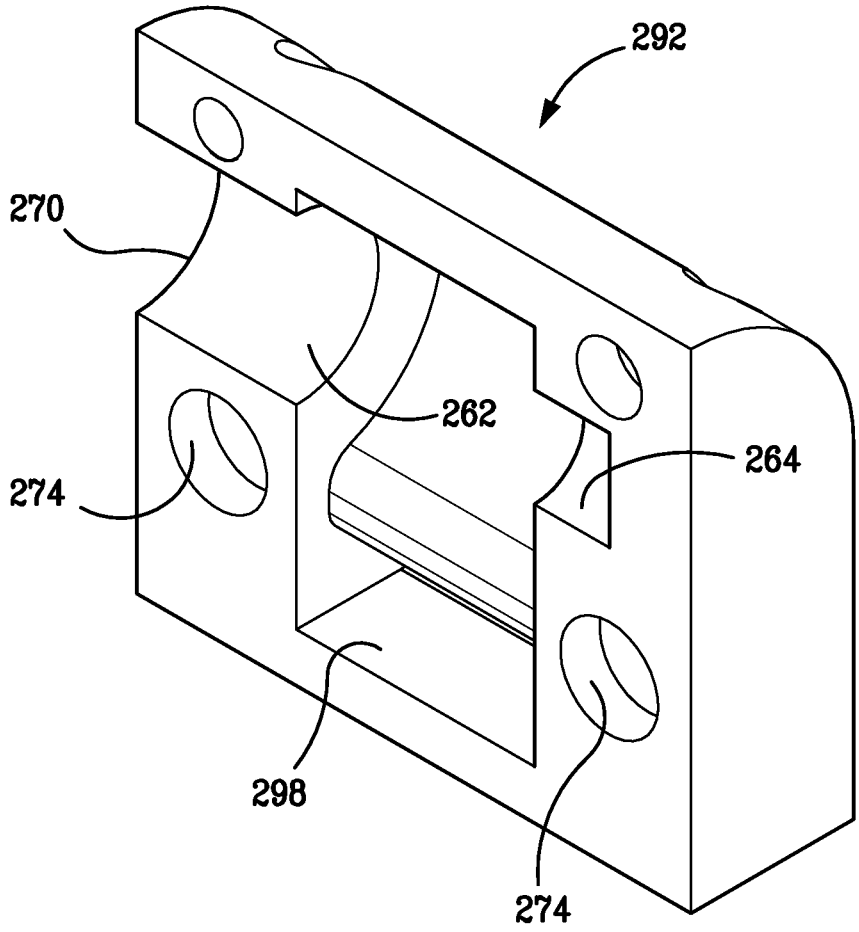
FIGS. 30-41 are views of the hinge base halves of the hinge assembly of the present invention.
Figure 31:
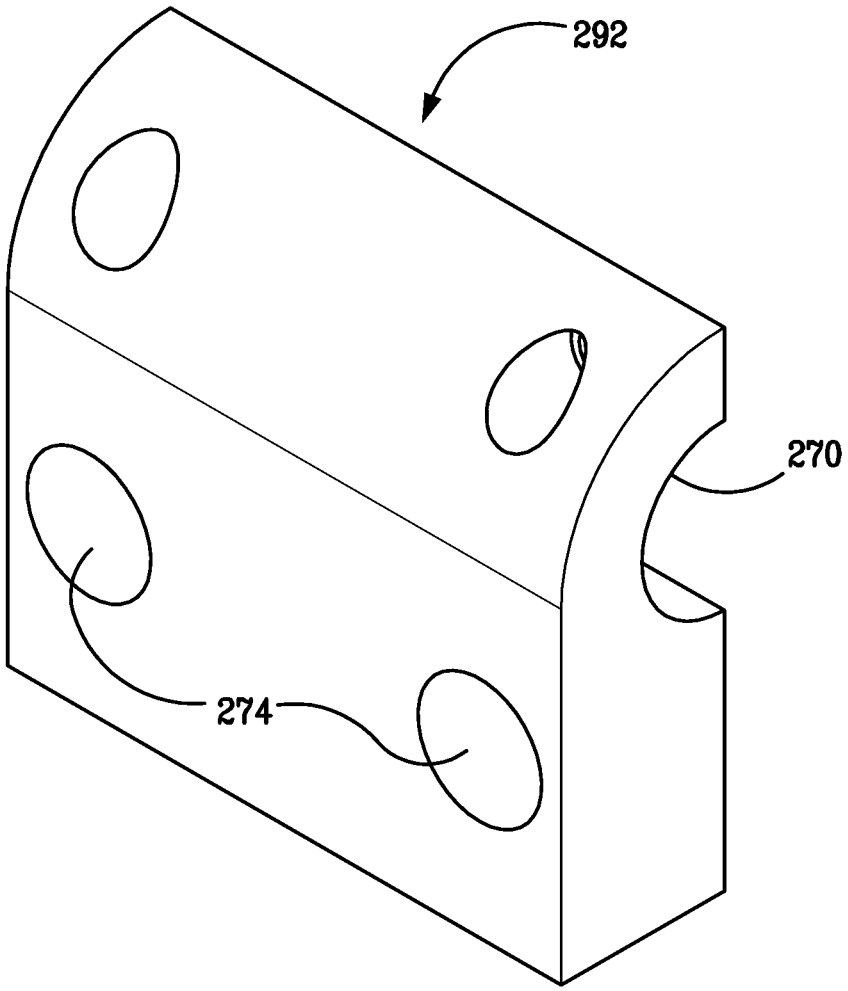
Figure 32:
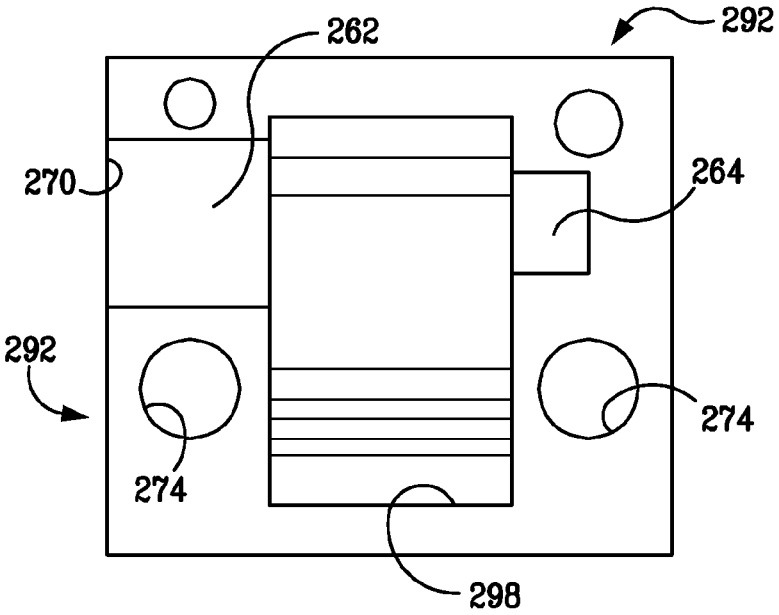
Figure 33:
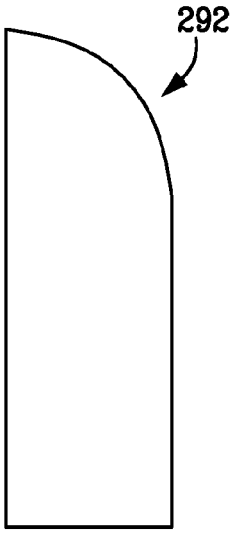
Figure 34:
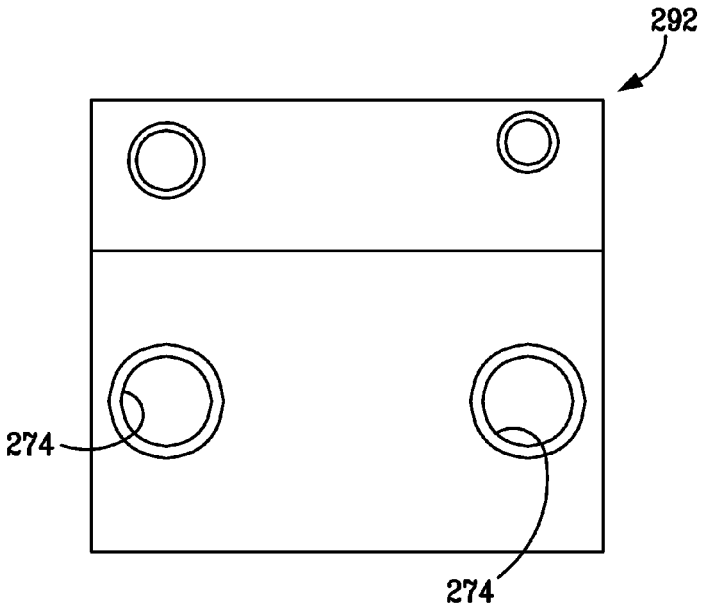
Figure 35:
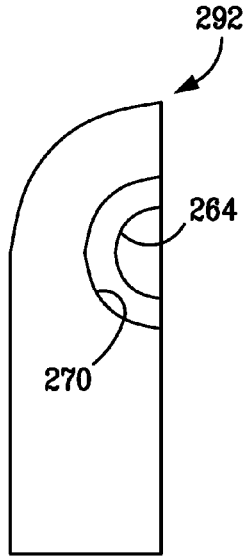
Figure 36:
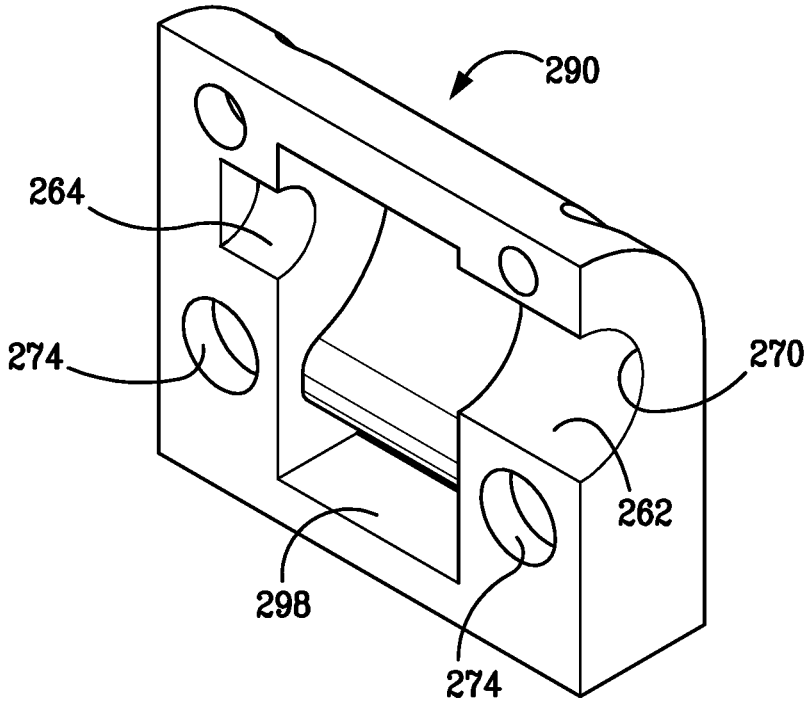
Figure 37:
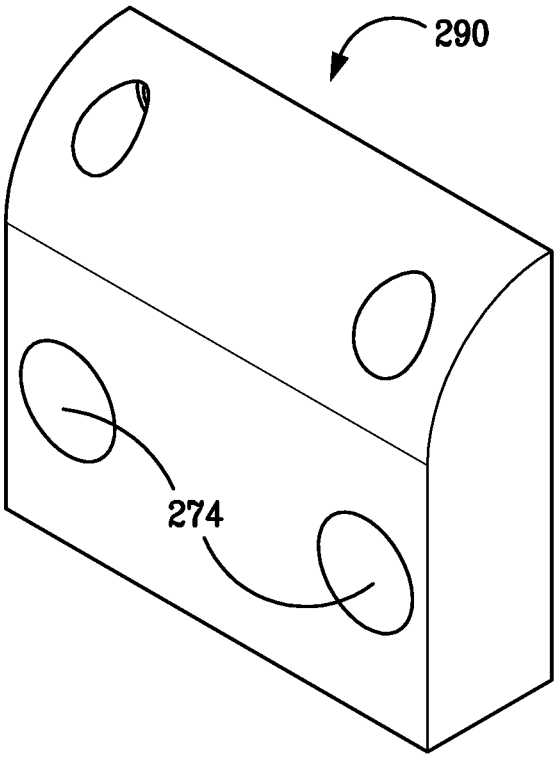
Figure 38:
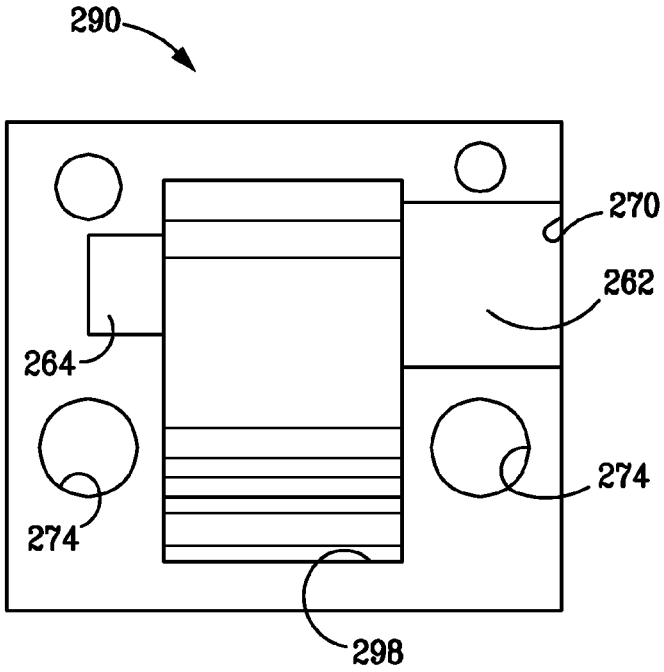
Figure 39:
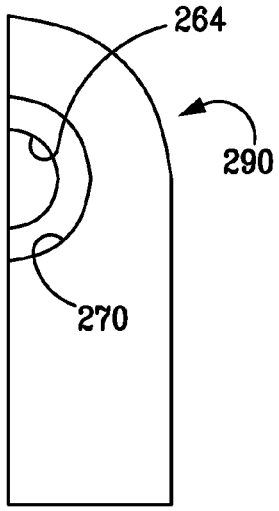
Figure 40:
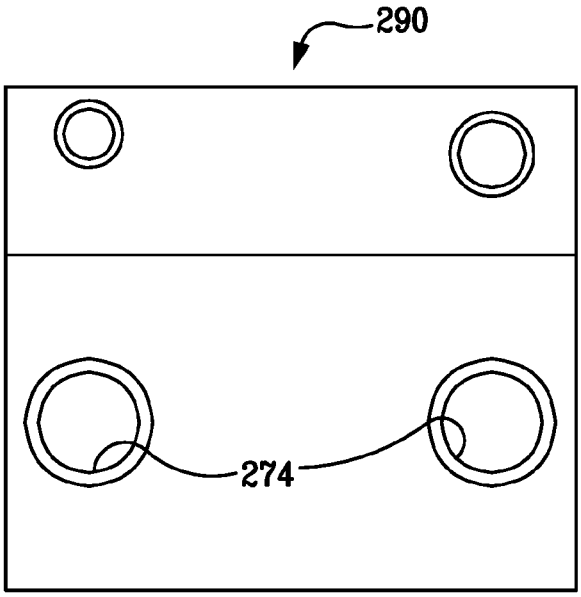
Figure 41:
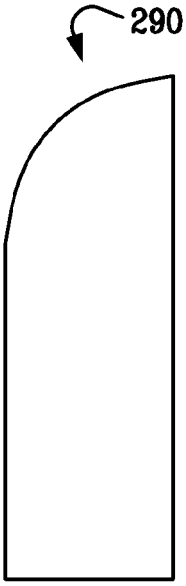
Figure 42:
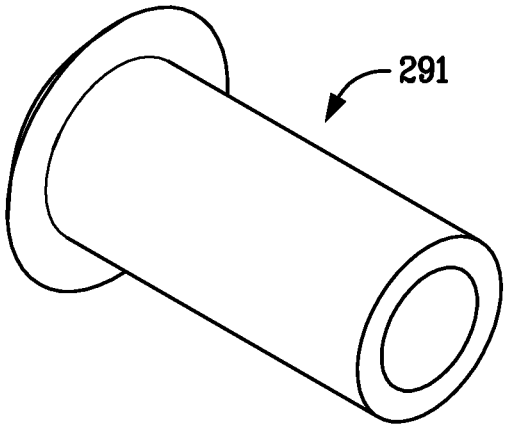
FIGS. 42-45 are views of the rivets for attaching the hinge base halves of the hinge assembly of the present invention.
Figure 43:
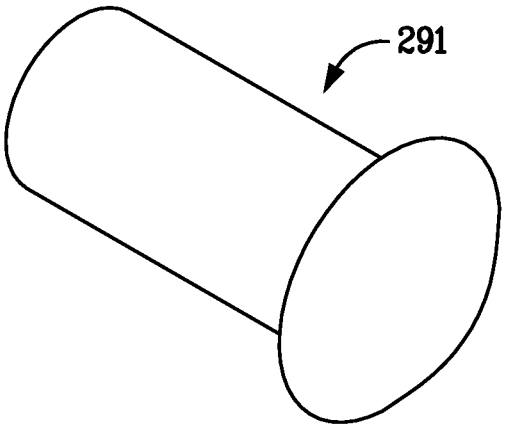
Figure 44:
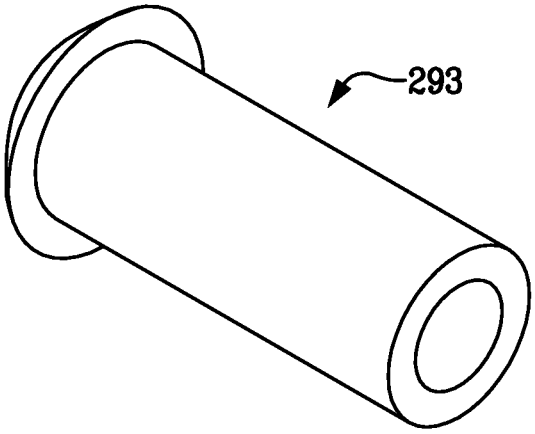
Figure 45:
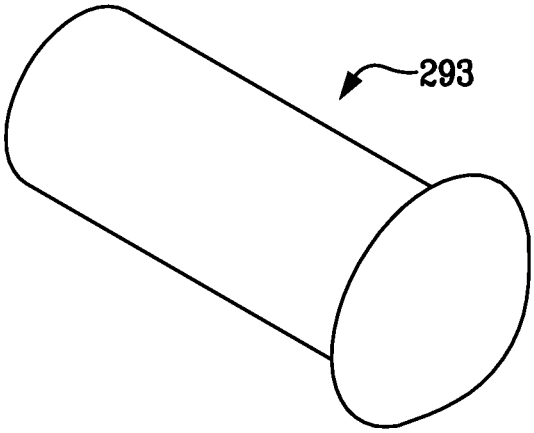
Figure 46:
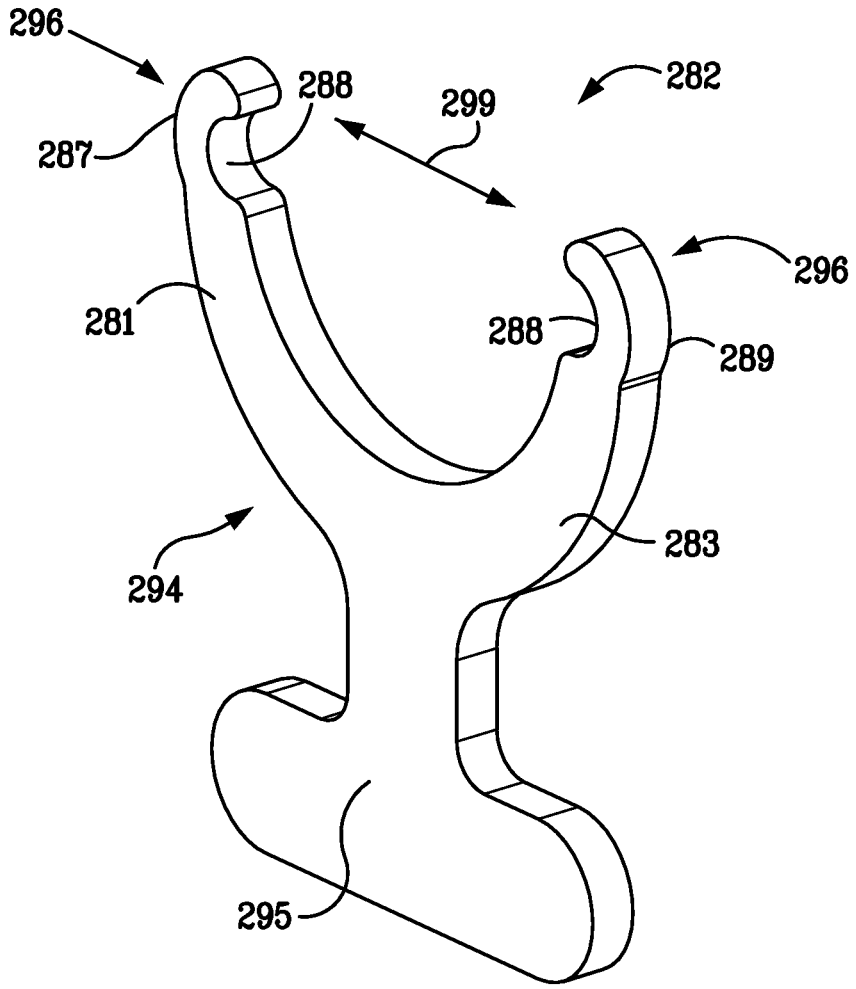
FIGS. 46-48 are views of the detent spring of the hinge assembly of the present invention.
Figure 47:
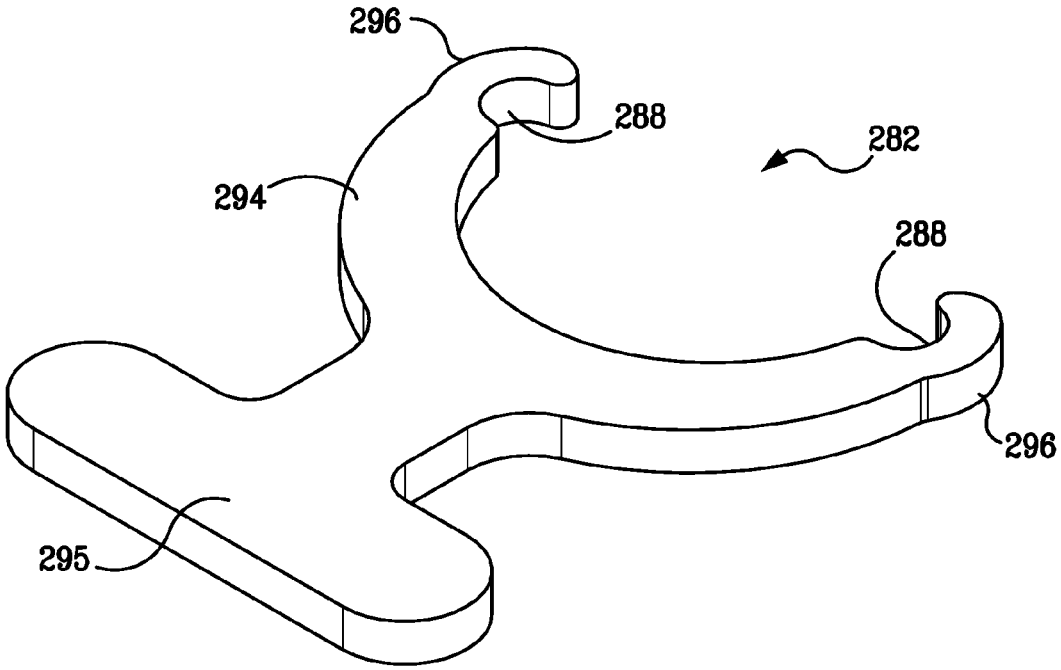
Figure 48:
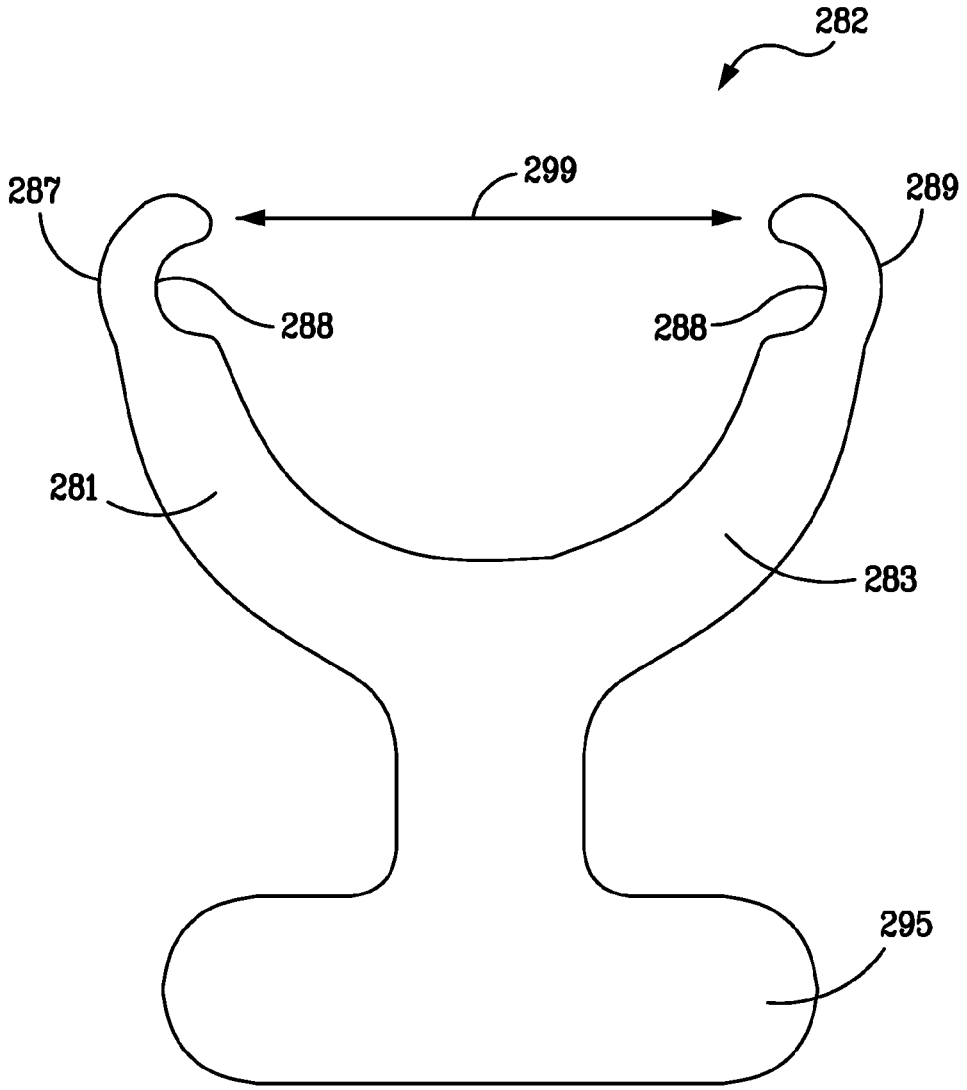
Figure 49:
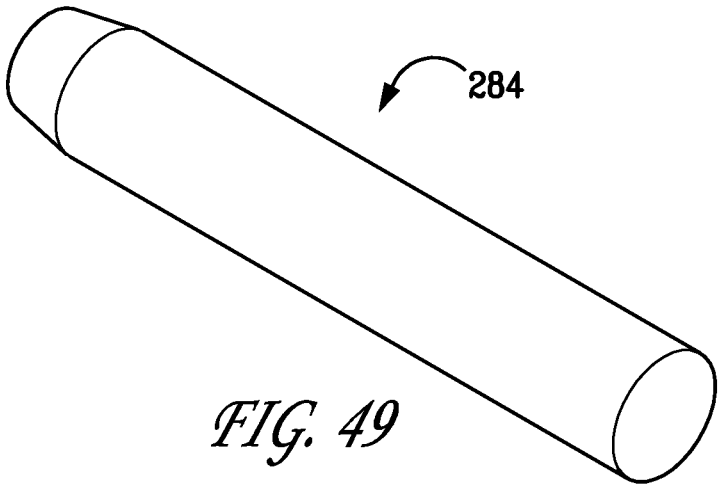
FIGS. 49-50 are views of the needle rollers of the hinge assembly of the present invention.
Figure 50:
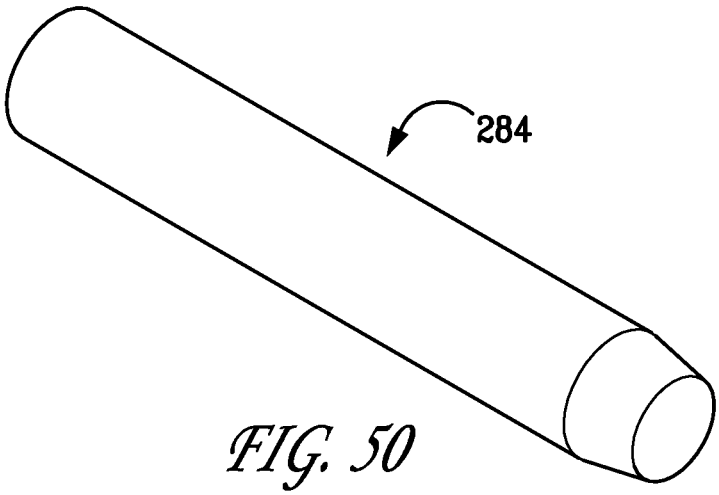
Figure 51:
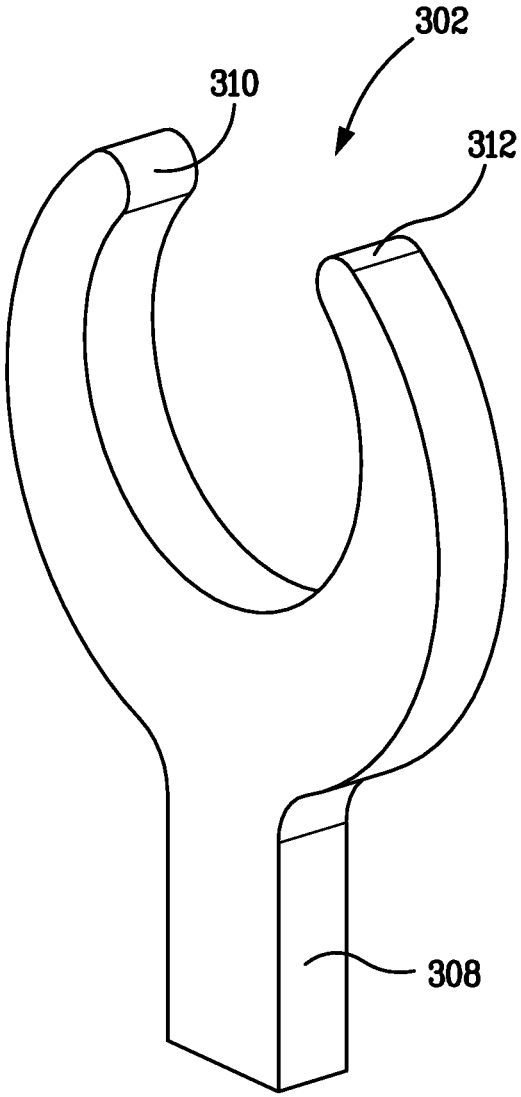
FIGS. 51-53 are views of the friction element of the hinge assembly of the present invention.
Figure 52:
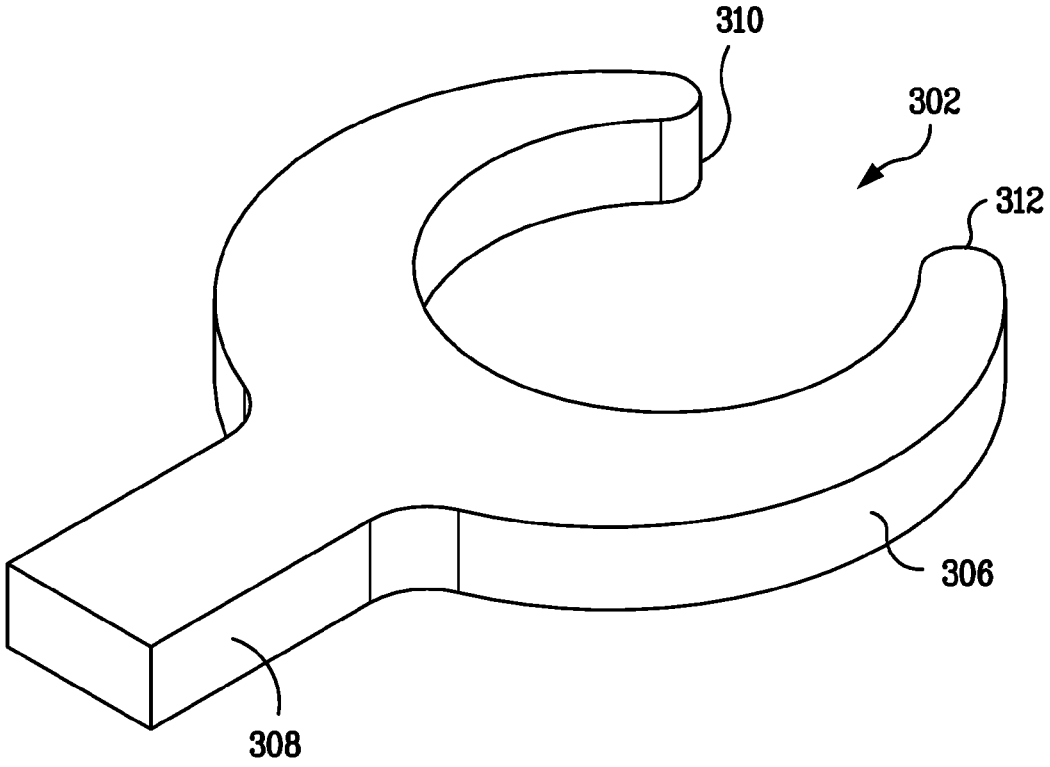
Figure 53:
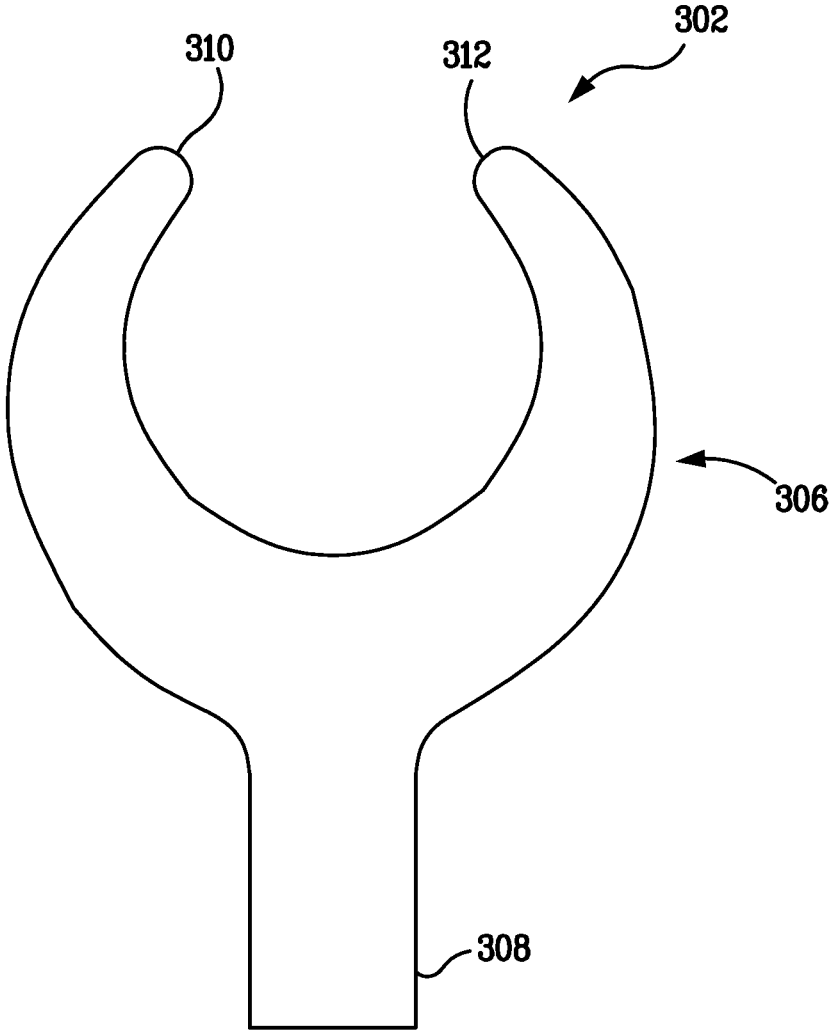

Referring to FIGS. 1-53, the present invention is directed to a hinge assembly 200 for rotationally attaching a first member to a second member to allow rotational movement of the first member relative to the second member between predetermined positions, which can include closed and open positions, detent positions, folded and raised positions, etc. Hinge assembly 200 is of the type known as a detent hinge or detent hinge assembly. Hinge and hinge assembly are used interchangeably herein.

The detent hinge 200 can be used to rotationally attach a first member to a second member to allow rotational movement of the first member relative to the second member. In the illustrated example, the first member is the box lid 204 and the second member is the box 202. However, the hinge 200 would be generally applicable as a hinge for pivotally attaching any type of door, lid, laptop computer screen, Digital Video Disc (DVD) player viewing screen, and the like to any type of base or opening frame. In the illustrated example, two hinge assemblies 200 that are mirror images of each other are used to pivotally attach a the box lid 204 to the box 202. The detent hinge 200 includes a hinge shaft 210, a first hinge part 240, a second hinge part 260, a detent mechanism 280, and a friction mechanism 300.

Referring to FIGS. 1-29, the hinge shaft 210 has at least a first end portion 212, a second portion 214 and a third portion 216. The first end portion 212 of the shaft 210 is provided with a plurality of elongated teeth 218 of triangular cross section evenly distributed about the circumference of the first end portion 212 of the shaft 210. Each of the plurality of elongated teeth 218 extends for at least the majority of the length of the first end portion 212 of the shaft 210.

In the illustrated example, the first hinge part 240 is in the form of an adaptor 240 adapted for attachment to the first member 204. The adaptor 240 is attached to the shaft 210 at the first end portion 212 of the shaft 210. The adaptor 240 is attached to the first end portion 212 of the shaft 210 such that the adaptor 240 is constrained to rotate with the shaft 210 as a unit. The adaptor 240 is adapted for fixed attachment to the first member 204 so as to move with the first member as a unit. Referring to FIGS. 1-29, the adaptor 240 has a body portion 242. The body portion 242 of the adaptor 240 is provided with a plurality of holes 244 to allow the adaptor 240 to be securely fastened to the first member 204 by screws 246.

The adaptor 240 has a bore 248 provided on one side of the body portion 242. The bore 248 of the adaptor 240 is designed to receive the first end portion 212 of the shaft 210 in a press fit or interference fit such that the shaft 210 is securely fastened to the adaptor 240 and the shaft 210 and the adaptor 240 are rotationally coupled to rotate together as a unit. The teeth 218 on the shaft's end portion 212 assist in rotationally coupling the shaft 210 to the adaptor 240 by providing a stronger grip between the internal surface of the bore 248 of the adaptor 240 and the exterior surface of the first end portion 212 of the shaft 210. Thus, the bore 248 of the adaptor 240 and the toothed exterior surface of the first end portion 212 of the shaft 210 form the means for securely fastening the shaft 210 to the adaptor 240 and rotationally coupling the shaft 210 and the adaptor 240 together in the illustrated embodiment.

Many other suitable means may also be employed for securely fastening the shaft 210 to the adaptor 240 and rotationally coupling the shaft 210 and the adaptor 240 together. The exterior surface of the first end portion 212 of the shaft 210 may be smooth and inserted into the bore 248 in an interference fit to secure and rotationally couple the shaft 210 and the adaptor 240 together. A key cooperating with slots in the shaft 210 and the bore 248 may be used to secure and rotationally couple the shaft 210 and the adaptor 240 together. Fasteners extending through the wall of the bore 248 either extending into corresponding holes in the shaft 210 or frictionally engaging the shaft 210 may be used to secure and rotationally couple the shaft 210 and the adaptor 240 together. Also, the adaptor 240 may be clamped to the shaft 210 using a clamping arrangement such as by providing a longitudinal slot that extends completely through the wall of the bore 248 and providing one or two flanges adjacent the longitudinal slot with screws that can be tightened to draw the edges of the longitudinal slot together to clamp the adaptor 240 to the shaft 210.

In the illustrated embodiment, the second hinge part 260 is a housing or base 260. Both the friction mechanism 300 and the detent mechanism 280 are housed in the hinge base 260. The hinge base 260 is adapted for fixed attachment to the second member 202 so as to move with the second member as a unit. The hinge base 260 has at least one bearing surface 262, 264 that rotationally supports the shaft 210 such that, when the adaptor 240 is attached to the first member 204 and the hinge base 260 is attached to the second member 202, the first member is rotationally attached to the second member such that the first member can rotationally move relative to the second member. The bearing surfaces 262, 264 of the hinge base 260 support corresponding portions 220, 222 of the shaft 210 to provide for rotational support of the shaft 210 by the hinge base 260.

Referring to FIGS. 1-45, in the illustrated example, the hinge base 260 has two bearing surfaces 262 and 264. The hinge base 260 has one side 266 that is closest to the adaptor 240 and one side 268 that is farthest from the adaptor 240. The side 266 has an opening 270 that allows the shaft 210 to extend outward from the hinge base 260 to the adaptor 240. The hinge base 260 is provided with a plurality of holes 274 to allow the hinge base 260 to be securely fastened to the second member 202 by screws 276. In the illustrated embodiment, the hinge base 260 is made in a "clam shell" configuration with two halves 290, 292 that fit together to form the base 260. In the illustrated example, rivets 291 and 293 are used to secure the two halves 290, 292 of the hinge base 260 together to form the base 260.

Referring to FIGS. 1-53, the detent hinge 200 is provided with a detent mechanism 280 that provides for increased resistance to relative rotation between the first hinge part 240 and the second hinge part 260, and in turn between the first hinged member 204 and the second hinged member 202, at one or more predetermined angular positions of the first hinge part 240 relative to the second hinge part 260, which correspond to one or more predetermined angular positions of the first hinged member 204 relative to the second hinged member 202. The one or more predetermined angular positions of the first hinge part 240 relative to the second hinge part 260, at which there is increased resistance to relative rotation between the first hinge part 240 and the second hinge part 260, correspond to the detent positions of the first hinge part 240, or of the first hinged member 204, relative to the second hinge part 260 or relative to the second hinged member 202. The increased resistance to relative rotation between the first hinge part 240 and the second hinge part 260, or between the first hinged member 204 and the second hinged member 202, refers to the fact that a torque equal to or higher than a predetermined threshold value must be applied between the first hinge part 240 and the second hinge part 260, or between the first hinged member 204 and the second hinged member 202, to bring about relative rotation between the first hinge part 240 and the second hinge part 260, and in turn between the first hinged member 204 and the second hinged member 202. This predetermined threshold torque value is higher than the threshold torque value required to cause relative rotation between the first hinge part 240 and the second hinge part 260, and in turn between the first hinged member 204 and the second hinged member 202, when the first hinge part 240, and by extension the first hinged member 204, is not in one of its detent positions.

For the sake of convenience statements such as, "the hinge 200 is in a detent position," are used herein as shorthand for stating that, "the first hinge part 240, or the first hinged member 204, is in a detent position relative to the second hinge part 260 or relative to the second hinged member 202. The threshold torque for moving the first hinged member 204 relative to the second hinged member 202 from a detent position of the first hinged member 204 is noticeably higher than the threshold torque for moving the first hinged member 204 relative to the second hinged member 202 when the first hinged member 204 is not in a detent position. The threshold torque for moving the first hinged member 204 relative to the second hinged member 202 from a detent position of the first hinged member 204 should be high enough to prevent most inadvertent movements of the first hinged member 204 relative to the second hinged member 202 due to the accelerations and/or jostling the first hinged member 204 is expected to be subjected to in its intended normal operating environment while permitting the deliberate movement of the first hinged member 204 relative to the second hinged member 202 by a human user.

The detent mechanism 280 includes one or more springs 282 that bias one or more needle rollers 284, also known as needle bearings, into engagement with the outer surface of the hinge shaft 210. The needle rollers 284 engage one or more grooves 286 in the surface of the hinge shaft 210 to provide the detent function of the hinge 200. Each spring 282 is in the form of a resilient band that surrounds at least a portion of the circumference of the hinge shaft 210. Each spring 282 is provided with one or more depressions or pockets 288 that face the surface of the hinge shaft 210 and that receive a portion of a respective needle roller 284. Each spring 282 that biases the needle roller 284 into engagement with the surface of the hinge shaft 210, hence forth referred to as a detent spring 282, is expanded outward from its relaxed state in order to fit around the shaft 210 and needle roller 284, especially when the needle roller 284 is out of the grooves 286 in the surface of the hinge shaft 210, such that each detent spring 282 exerts a force on the needle roller 284 that acts to press the needle roller 284 against the surface of the hinge shaft 210. The force exerted by each detent spring 282 on the needle roller 284 generates a force between the needle roller 284 and the surface of the hinge shaft 210 that is generally directed radially toward the central longitudinal axis of the hinge shaft 210. Each detent spring 282 presses the needle roller 284 against the surface of the hinge shaft 210 with some force at least when the needle bearing 284 is not positioned in any of the grooves 286 in the surface of the hinge shaft 210; but, more preferably each detent spring 282 does so at all times. The needle roller 284 can roll on the surface of the hinge shaft 210 as the hinge shaft 210 is rotated relative to the spring 282.

The hinge shaft 210 is fixed to the first hinge part 240 such that the hinge shaft 210 rotates with the first hinge part 240 as a unit and in turn with the first hinged member 204 when the first hinge part 240 is secured to the first hinged member 204. The hinge shaft 210 is supported by the second hinge part 260 for rotational movement relative to the second hinge part 260. The detent spring 282 is housed in the second hinge part 260 and is prevented from rotating relative to the second hinge part 260. Accordingly, the detent hinge assembly 200 is provided with means to prevent the rotation of the detent spring 282 relative to the second hinge part 260. The detent position of the first hinged member 204 or of the first hinge part 240 corresponds to an angular position of the first hinged member 204 or of the first hinge part 240, respectively, relative to the second hinge part 260, and in turn relative to the second hinged member 202, at which one or more of the needle rollers 284 is engaging a groove 286 in the surface of the hinge shaft 210.

In the illustrated example, each detent spring 282 has a curved portion 294 that is resilient and surrounds at least a portion of the hinge shaft 210. The curved portion 294 forms the resilient band that surrounds at least a portion of the hinge shaft 210, which was described above. The curved portion 294 has two free ends 296. Each free end 296 is provided with a pocket 288. The curved portion 294 is adapted to position the pockets 288 such that the pockets 288 face the surface of the hinge shaft 210. The pockets 288 each receive a portion of a respective needle roller 284. The curved portion 294 is preferably sized such that the pockets 288 at the ends of the curved portion 294 position the needle rollers 284 on either side of the shaft 210 and across from one another. The curved portion 294 is more preferably sized such that the pockets 288 at the ends of the curved portion 294 are in facing relationship and position the needle rollers 284 on either side of the shaft 210 and across from one another approximately level with the central longitudinal axis of the shaft 210.

The pockets 288 provide a bearing surface for rotationally supporting the needle rollers 284 against the surface of the hinge shaft 210. Preferably, the bearing surfaces of the pockets 288 are in the shape of the outer surface of a sector of a right circular cylinder. The detent springs 282 apply compression force onto the centrally positioned generally cylindrical portion 214 of the hinge shaft 210 having the detent grooves 286. The force generated by the detent springs 282 is applied to the hinge shaft 210 through the cylindrical needle rollers 284 and maintains the needle rollers 284 in contact with the surface of the hinge shaft 210 and ensures that the needle rollers 284 engage the detent grooves 286 when the detent grooves 286 register with the needle rollers 284. The needle rollers 284 are positioned in part in the pockets 288 of the detent springs 282. Each of the needle rollers 284 is received at least in part in a corresponding groove 286 when the needle rollers 284 are in engagement with the grooves 286. Each needle roller 284 is in the form of a right circular cylinder that has a frusto-conical portion at one end. Accordingly, each needle roller 284 has first and second end portions with a cylindrical surface extending between then. The term "cylindrical roller" as used herein refers to any roller whose bearing surface is cylindrical even if its end portions deviate from a perfect cylinder.

The hinge shaft 210 can be of one or more pieces including one-piece and two-piece configurations. In the illustrated example, the hinge shaft 210 is of two-piece construction and includes a shaft portion 224 and a sleeve portion 226 that are attached together such that they rotate as a unit. The detent grooves 286 are provided in the outer surface of the sleeve portion 226. This arrangement permits some degree of customization of the hinge to match each customer's specific requirements with a minimum amount of tooling and part changes and of the associated costs. Simply by changing the number and positions of the detent grooves 286, the detent positions of the hinge 200 can be customized to meet individual customer requirements. In the illustrated example, the sleeve portion 226 has internal teeth 228 that engage with external teeth 229 provided on a portion of the shaft portion 224 that corresponds to the portion 214 of the hinge shaft 210 such that the shaft portion 224 and the sleeve portion 226 rotate as a unit.

Fundamentally, each detent spring 282 can be thought of as being in the form of two resilient arms 281, 283 attached together to form the detent spring resilient portion 294. The attachment between the resilient arms 281, 283 defines the middle or center portion 285 of the spring 282 and the terminal end portions 287, 289 of the resilient arms 281, 283 define the end portions 296 of the detent spring 282. The terminal end portions 287, 289 of the resilient arms 281, 283, and consequently the end portions 296 of the detent spring 282, are spaced apart such that they define a gap 299 in the detent spring resilient portion 294. The attachment between the resilient arms 281, 283, which defines the center or middle 285 of the detent spring resilient portion 294, is located opposite the gap 299. Cutouts in the end portions 296 of the detent spring resilient portion 294 form the pockets 288 that define surfaces that match a portion of the outer cylindrical surface of the rollers 284 to define journal bearings adapted to rotationally support the rollers 284 and to help maintain the rollers 284 in a fixed location relative to the detent spring 282 in the assembled hinge 200. When the hinge 200 is fully assembled, the end portions 296 of the detent spring 282 are spread apart compared to the relaxed state of the detent spring 282 due to the positioning of the hinge shaft 210 and the needle rollers 284. This arrangement results in the force generated by the detent springs 282 that maintains the one or more needle rollers 284, that are supported at least in part by the one or more pockets 288 of the detent spring 282, in contact with the surface of the hinge shaft 210 and ensures that the needle rollers 284 engage the detent grooves 286 when the detent grooves 286 register with the needle rollers 284.

As previously mentioned, each of the one or more detent springs 282 of the hinge 200 is provided with means to prevent the rotation of the detent spring 282 relative to the hinge base or housing 260. In the illustrated example, each detent spring 282 has a projection 295 attached to the resilient portion 294 and extending outward from the outer perimeter of the resilient portion 294. In the fully assembled hinge 200, the outer perimeter of the resilient portion 294 faces away from the hinge shaft 210 and the inner perimeter of the resilient portion 294 faces toward the hinge shaft 210. Accordingly, the projection 295 extends outward from the resilient portion 294 in a direction away from the hinge shaft 210 and in a radial direction relative to the central longitudinal axis of the hinge shaft 210. In the illustrated embodiment, the projection 295 extends from the center of the resilient portion 294 and is in the form of a leg that is substantially in the shape of a "T". The legs 295 of the detent springs 282 are received in a channel 297 formed in the hinge base or housing 260 to prevent the detent springs 282 from rotating with the shaft 210. Thus, the detent springs 282 are prevented from rotating relative to the hinge base 260. In principle, the leg 295 of each detent spring 282 can be any shape capable of engaging a blocking structure in the hinge base 260 in order to prevent the detent spring 282 from rotating relative to the hinge base 260. The legs 295 may even have the same shape as the stem 308 of the friction element 302. However, it is preferred that the legs 295 be shaped such that they completely fix the radial position of the detent spring 282 relative to the central longitudinal axis of the shaft 210 to more accurately position the rollers 284 relative to the shaft 210 to provide the specified detent positions within tighter tolerances.

In the illustrated embodiment, the channel 297 has a cross section substantially in the shape of a "T" to match the shape of the legs 295 of the detent springs 282. In the illustrated embodiment, the channel 297 and the channel 278 are formed by a single channel 298, extending parallel to a portion of the shaft 210, with one channel being an extension of the other. However, it is possible for the channels 297 and 278 to be separate or to be of different shapes.

Referring to FIGS. 1-53, the detent hinge 200 is provided with a friction mechanism 300 for frictionally resisting rotational motion of the shaft 210 relative to the hinge base 260. The friction mechanism 300 is optional and provides for a controlled resistance to the rotation of the shaft 210 when the adaptor 240 moves from one predetermined detent position to another. The friction mechanism 300 is supported by the hinge base 260. The friction mechanism 300 is located in the base 260 at a position corresponding to the third portion 216 of the shaft 210. The friction mechanism 300 includes one or more friction elements 302, a channel 278, and the third portion 216 of the shaft 210. The hinge base 260 has a channel 278 that extends over the length of at least a portion of the third portion 216 of the shaft 210 in a direction parallel to the longitudinal axis of the shaft 210. The friction elements 302 are of the symmetrical friction clip type and have a C-shaped portion 306 and a stem 308. The stem 308 projects outward from the outer surface of the C-shaped portion 306 at a location opposite the gap between the tips 310 and 312 of the C-shaped portion 306. The friction elements 302 engage the third portion 216 of the shaft 210. The inner radius of the C-shaped portion 306 is smaller than the radius of the outer surface of the third portion 216 of the shaft 210 so that the C-shaped portion 306 expands when placed around the third portion 216 of the shaft 210. The resilience of the C-shaped portion 306 of the friction elements 302 causes the C-shaped portions 306 of the friction elements 302 to exert a gripping force on the third portion 216 of the shaft 210. Thus, the friction elements 302 applying pressure onto the surface of the shaft 210 to add resistance to hinge shaft rotation.

The stems 308 of the friction elements 302 are received in the channel 278 to prevent the friction elements 302 from rotating with the shaft 210. Thus, the friction elements 302 are prevented from rotating relative to the hinge base 260. The gripping force exerted by the C-shaped portions 306 of the friction elements 302 on the shaft 210 generates a friction torque that resists rotational motion of the shaft 210 relative to the hinge base 260. The friction torque generated by the friction elements 302 can be matched to any specified value for a particular application by adjusting the geometry, number and material of the friction elements 302. The base 260 encloses the friction elements 302 and keeps dirt and abrasive particles out of the friction mechanism 300 and keeps lubricant, needed to ensure smooth hinge operation and prevent premature friction element failure, confined to the interior of the base 260. In the illustrated example, there is one friction element 302.

The shaft 210 is made of steel. The adaptor 240 and the hinge base 260 can be made of a die cast metal such as aluminum or zinc or of a high impact plastic.

The illustrated embodiment of the detent hinge 200 can be used, for example, for the pivotal attachment of the viewing screen of the LCD type of a laptop computer or a DVD player as well as the box lid 204 as illustrated in the drawings. The hinge 200 is provided with two detent positions. In use, two hinges 200 are mounted on common axis. Each illustrated hinge 200 provides a rotational motion profile with two detent positions at 100° and 120° from the horizontal. Holding torque of the hinge 200 in its detent positions is intended to be up to approximately 20 lb-in. The resistance to rotation of the hinge 200 when out of its detent positions is less than 10% of the holding torque in its detent positions. Total travel of the hinge 200 is approximately 180°. The maximum thickness of the hinge base 260, measured in a direction parallel to the axial direction of the mounting holes 274, is approximately 10 mm or less.

The hinge 200 has few parts and its parts are easy to manufacture. The hinge 200 provides a high amount of detent torque and permits the angular rotation between its detent positions to be made smaller than heretofore possible, all in a tightly confined radial envelope or space. This combination of features has heretofore eluded designers in this area. The key to the achievement of this combination of characteristics is the use of the yoke-shaped detent spring element 282 to radially apply a spring force on both sides of a shaft 210 through relatively small diameter needle or pin rollers 284 positioned between the yoke arms of the spring 282 and the shaft surface. The yoke arms 281, 283 are shaped not only to efficiently optimize spring load stresses (the overall crescent shape of each arm) but also are shaped with pockets 288 in the ends of each arm to hold and position the needle rollers 284 opposite each other across the diameter of the shaft 210. The needle rollers 284 roll as the shaft 210 turns relative to the housing 260. The detent springs 282 are relatively stiff springs, providing very high loads with relatively little deformation.

In the hinge 200, the detent positions can be approximately 20° or less apart. In the illustrated embodiment, two pairs of opposing grooves 286 are provided in the shaft 210. Each pair of opposing grooves 286 corresponds to one of the two detent positions of the hinge 200. Each of the grooves forming a pair of opposing grooves 286 that correspond to a given detent position is simultaneously engaged by a respective one of the pair of needle rollers 284 to hold the hinge 200 in that given detent position. Each pair of opposing grooves 286 that correspond to a given detent position are located on opposite sides of the hinge shaft 210 along a line that passes through the central longitudinal axis of the shaft 210. The imaginary line extending across the shaft 210 between the first pair of grooves 286 and the imaginary line extending across the shaft 210 between the second pair of grooves 286 form an acute angle of approximately 20°. Thus, each pair of grooves 286 corresponds to a respective one of the detent positions at 100° and 120° from the horizontal. The needle rollers 284 distribute the spring force along their length such that the pressure on the shaft 210 is reduced resulting in less wear of the hinge shaft 210, which is one of the more expensive components of the hinge 200, as compared to detent hinges that use spherical ball bearings for the detent mechanism of the hinge. The detent spring 282 is self-contained as compared with the coil spring of prior art hinges in the sense that it does not rely on reaction forces between the spring and the housing to generate the biasing force applied to the needle rollers 284 so that the detent spring 282 reduces the stresses to which the hinge housing is subjected. The holding torque at the detent positions of hinge 200 can be customized to meet customer requirements by varying the number of detent springs 282 in the hinge housing. In the illustrated example, three detent springs 282 are used. The rotational resistance of the hinge 200 when the hinge 200 is out of its detent positions can be customized by varying the number or stiffness of the friction element or elements 302.

Figure 54:
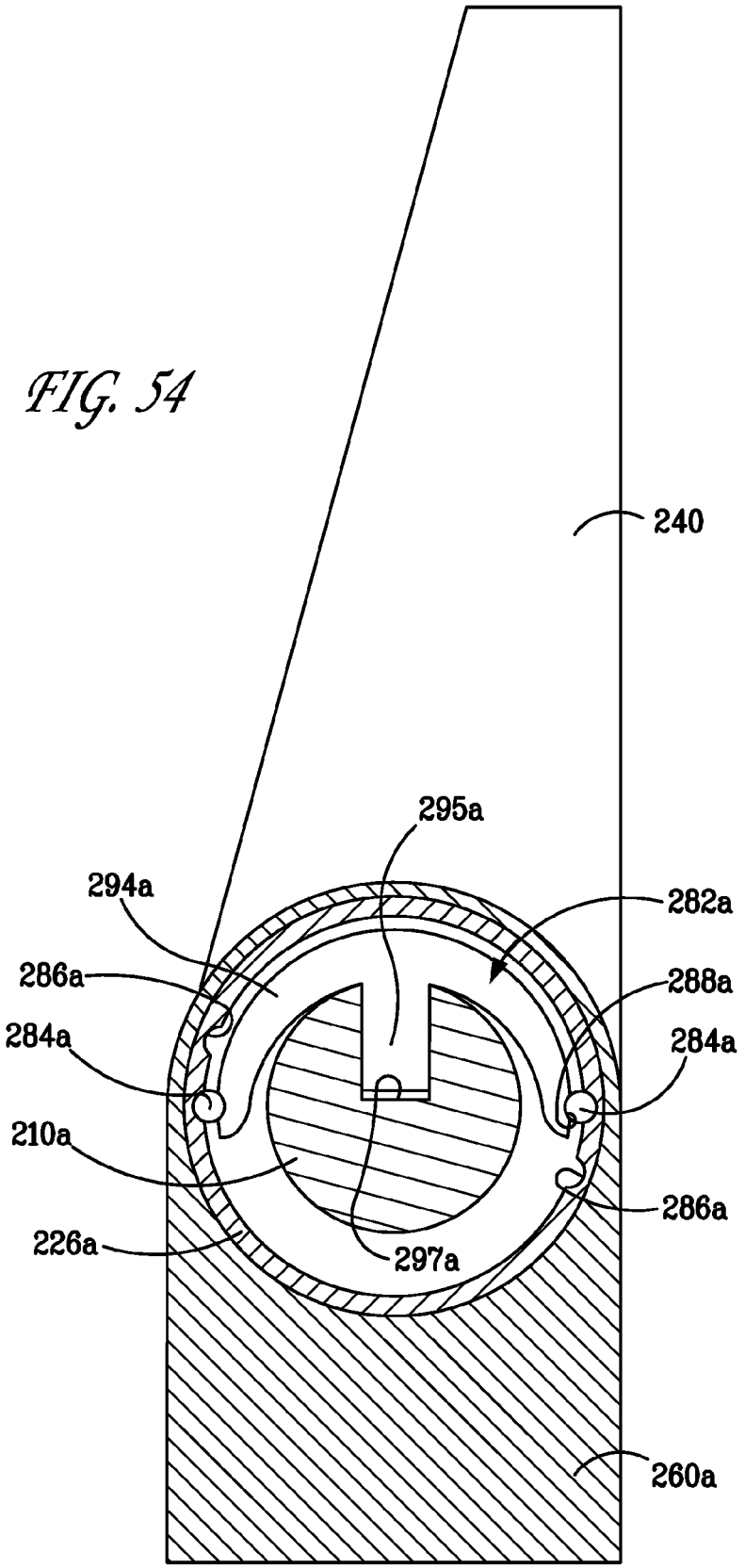
FIG. 54 is a cross sectional view of the second embodiment of a detent hinge made according to the present invention.

As an alternative to the first embodiment 200, it is possible to reverse the positions of the channel 297 and the grooves 286 as shown in FIG. 54. In such an embodiment the grooves 286*a* are provided in the hinge base 260*a* and the channel 297*a* is provided in the hinge shaft 210*a*. When this alternative hinge is fully assembled, the end portions 296*a* of the detent spring 282*a* would be forced closer to each other as compared to the relaxed state of the detent spring 282*a* due to the positioning of the interior surface of the hinge base and the needle rollers 284*a*. The journal bearing surfaces 288*a* would then be provided on the outer perimeter of the resilient portion 294*a* rather than on the inner perimeter of the resilient portion 294, which was the case with embodiment 200. This arrangement causes the force generated by the detent springs 282*a* to maintain the one or more needle rollers 284*a*, that are supported at least in part by the one or more journal bearing surfaces 288*a* of the detent spring, in contact with the inner surface of the hinge base 260*a* and ensures that the needle rollers 284*a* engage the detent grooves 286*a* when the needle rollers 284*a* register with the detent grooves 286*a*. Thus, the arms of the detent springs 282*a* press the rollers against the interior surface of the hinge base. The projection 295*a* of the detent springs 282*a* would extend toward the gap between the free ends of the resilient portion 294*a* and would engage the channel 297*a* in the shaft 210*a* to prevent relative rotation between the detent springs 282*a* and the shaft 210*a*. Otherwise the two embodiments would essentially be identical. The grooves 286*a* could similarly be provided in a separate sleeve 226*a* that is attached to the hinge base 260*a* and fixed against rotation relative to the hinge base 260*a* in order to provide for easy customization.

It is to be understood that the present invention is not limited to the embodiments described above, but encompasses any and all embodiments within the scope of the following claims.

The invention claimed is:

1. A hinge assembly for rotationally attaching a first member to a second member to allow rotational movement of the first member relative to the second member, the hinge assembly comprising:

(a) a shaft having at least a first portion and a second portion;

(b) an adaptor attached to said first portion of said shaft such that said adaptor is constrained to rotate with said shaft as a unit, said adaptor being adapted for attachment to the first member so as to move with the first member as a unit;

(c) a hinge base adapted for attachment to the second member so as to move with the second member as a unit, said hinge base rotationally supporting said shaft such that, when said adaptor is attached to the first member and said hinge base is attached to the second member, the first member is rotationally attached to the second member such that the first member can move pivotally relative to the second member; and (d) a detent mechanism for holding said adaptor in at least one detent position relative to said hinge base as long as a torque applied between said adaptor and said hinge base is lower than a threshold torque value, said detent mechanism comprising at least one cylindrical roller having a first end portion, a second end portion, and a cylindrical surface extending between said first end portion of said roller and said second end portion of said roller, at least one groove provided in one of said second portion of said shaft and said hinge base, and biasing means for biasing said roller into engagement with said groove such that said roller engages said groove when said adaptor is in said detent position relative to said hinge base, wherein said biasing means comprises:

at least one journal bearing surface matching at least a portion of said cylindrical surface of said roller for rotationally supporting said roller such that said journal bearing surface has the shape of a sector of a cylindrical surface;

at least one resilient arm having at least one free end portion, said journal bearing surface being provided in said free end portion of said resilient arm; and means for preventing relative rotation between said biasing means and one of said shaft and said hinge base.

2. The hinge assembly of claim 1, wherein said biasing means defines a detent spring and the hinge base is adapted to allow a number including one or more of said detent springs to be included in the hinge assembly such that said threshold torque value can be varied by varying said number of said detent springs.

3. The hinge assembly of claim 1, wherein the threshold torque value is a first threshold torque value, wherein said adaptor is prevented from rotation relative to said hinge base as long as a torque applied between said adaptor and said hinge base is lower than a second threshold torque value when said adaptor is not in any detent position relative to said hinge base, and wherein said second threshold torque value is less than said first threshold torque value.

4. The hinge assembly of claim 3, further comprising:

a friction mechanism for frictionally resisting rotational motion of said shaft relative to said hinge base, said friction mechanism including one or more friction elements housed in said hinge base.

5. The hinge assembly of claim 1, wherein said at least one groove is formed in a separate sleeve that is attached to and fixed against rotation relative to one of said shaft and said hinge base to provide for easy customization.

6. A hinge assembly for rotationally attaching a first member to a second member to allow rotational movement of the first member relative to the second member, the hinge assembly comprising:

(a) a shaft having at least a first portion and a second portion;

(b) an adaptor attached to said first portion of said shaft such that said adaptor is constrained to rotate with said shaft as a unit, said adaptor being adapted for attachment to the first member so as to move with the first member as a unit;

(c) a hinge base adapted for attachment to the second member so as to move with the second member as a unit, said hinge base rotationally supporting said shaft such that, when said adaptor is attached to the first member and said hinge base is attached to the second member, the first member is rotationally attached to the second member such that the first member can move pivotally relative to the second member; and (d) a detent mechanism for holding said adaptor in at least one detent position relative to said hinge base as long as a torque applied between said adaptor and said hinge base is lower than a threshold torque value, said detent mechanism comprising a pair of cylindrical rollers each having a first end portion, a second end portion, and a cylindrical surface extending between said first end portion of said roller and said second end portion of each of said rollers, a pair of grooves provided in one of said second portion of said shaft and said hinge base, and biasing means for biasing each of said rollers into engagement with a corresponding one of said grooves such that each of said rollers engages a corresponding one of said grooves when said adaptor is in said at least one detent position relative to said hinge base, wherein said biasing means comprises:

a pair of journal bearing surfaces each matching at least a portion of said cylindrical surface of a corresponding one of said rollers for rotationally supporting said corresponding one of said rollers such that each of said journal bearing surfaces has the shape of a sector of a cylindrical surface;

first and second resilient arms each having at least one free end portion, each of said pair of journal bearing surfaces being provided in said free end portion of a respective one of said first and second resilient arms; and means for preventing relative rotation between said biasing means and one of said shaft and said hinge base.

7. The hinge assembly of claim 6, wherein said first and second resilient arms are attached to one another such that they define a resilient portion of said biasing means, the attachment between said first and second resilient arms defines the middle portion of said resilient portion of said biasing means, and said free end of said first resilient arm is spaced apart from said free end of said second resilient arm so as to define a gap between said free end of said first resilient arm and said free end of said second resilient arm, said middle portion of said resilient portion of said biasing means being positioned opposite said gap, and wherein said means for preventing relative rotation is attached to said middle portion of said resilient portion of said biasing means.

8. The hinge assembly of claim 7, wherein said pair of grooves is provided in said second portion of said shaft and wherein said means for preventing relative rotation comprises a projection extending from said middle portion of said resilient portion of said biasing means in a direction away from said gap; and a channel provided in said hinge base, wherein said projection engages said channel to prevent relative rotation between said biasing means and said hinge base.

9. The hinge assembly of claim 8, wherein said projection is substantially in the shape of a "T", and said channel has a cross section that substantially matches the "T" shape of said projection.

10. The hinge assembly of claim 7, wherein said pair of grooves is provided in said hinge base and wherein said means for preventing relative rotation comprises a projection extending from said middle portion of said resilient portion of said biasing means in a direction toward said gap; and a channel provided in said shaft, wherein said projection engages said channel to prevent relative rotation between said biasing means and said shaft.

11. The hinge assembly of claim 8, wherein said biasing means defines a detent spring and the hinge base is adapted to allow a number including one or more of said detent springs to be included in the hinge assembly such that said threshold torque value can be varied by varying said number of said detent springs.

12. The hinge assembly of claim 11, wherein said at least one detent position is a first detent position, wherein said pair of grooves is a first pair of grooves, and wherein the hinge assembly further comprises a second pair of grooves provided in said second portion of said shaft such that said pair of rollers engage said first pair of grooves when said adaptor is in said first detent position relative to said hinge base in order to hold said adaptor in said first detent position relative to said hinge base as long as a torque applied between said adaptor and said hinge base is lower than said threshold torque value and such that said pair of rollers engage said second pair of grooves when said adaptor is in a second detent position relative to said hinge base in order to hold said adaptor in said second detent position relative to said hinge base as long as a torque applied between said adaptor and said hinge base is lower than said threshold torque value.

13. The hinge assembly of claim 12, wherein said grooves are formed in a separate sleeve that is attached to and fixed against rotation relative to said shaft to provide for easy customization.

14. The hinge assembly of claim 6, wherein said at least one detent position is a first detent position, wherein said pair of grooves is a first pair of grooves, and wherein the hinge assembly further comprises a second pair of grooves provided in one of said second portion of said shaft and said hinge base such that said pair of rollers engage said first pair of grooves when said adaptor is in said first detent position relative to said hinge base in order to hold said adaptor in said first detent position relative to said hinge base as long as a torque applied between said adaptor and said hinge base is lower than said threshold torque value and such that said pair of rollers engage said second pair of grooves when said adaptor is in a second detent position relative to said hinge base in order to hold said adaptor in said second detent position relative to said hinge base as long as a torque applied between said adaptor and said hinge base is lower than said threshold torque value.

15. The hinge assembly of claim 14, wherein the threshold torque value is a first threshold torque value, wherein said adaptor is prevented from rotation relative to said hinge base as long as a torque applied between said adaptor and said hinge base is lower than a second threshold torque value when said adaptor is not in any detent position relative to said hinge base, and wherein said second threshold torque value is less than said first threshold torque value.

16. The hinge assembly of claim 15, further comprising:

a friction mechanism for frictionally resisting rotational motion of said shaft relative to said hinge base, said friction mechanism including one or more friction elements housed in said hinge base.

* * * * *

UNITED STATES PATENT AND TRADEMARK OFFICE

CERTIFICATE OF CORRECTION

PATENT NO. : 8,555,465 B2
APPLICATION NO. : 13/340972
DATED : October 15, 2013
INVENTOR(S) : Eugene Novin It is certified that error appears in the above-identified patent and that said Letters Patent is hereby corrected as shown below:

In the Specification

Column 2, line 12, reads "friction, which can cause faster wear as compared to the ware"
should read -- friction, which can cause faster wear as compared to the wear --

Column 2, line 54, reads "engagement with the surface of the hinge shaft, hence forth"
should read -- engagement with the surface of the hinge shaft, henceforth --

Column 3, line 26, reads "of the hinge shaft. None of the prior art teach or suggest the"
should read -- of the hinge shaft. None of the prior art teaches or suggests the --

Column 3, line 28, reads "none of the prior art teach or suggest the use of needle rollers"
should read -- none of the prior art teaches or suggests the use of needle rollers --

Column 4, line 60, reads "to pivotally attach a the box lid 204 to the box 202. The detent"
should read -- to pivotally attach the box lid 204 to the box 202. The detent --

Column 7, line 16, reads "of the hinge shaft 201, hence forth referred to as a detent"
should read -- of the hinge shaft 201, henceforth referred to as a detent --

Column 10, line 37, reads "hinges 200 are mounted on common axis. Each illustrated"
should read -- hinges 200 are mounted on a common axis. Each illustrated --

Column 11, line 10, reads "respond to a given detent position are located on opposite"
should read -- respond to a given detent position is located on opposite --

Signed and Sealed this
Seventeenth Day of December, 2013

Margaret A. Focarino

Margaret A. Focarino
*Commissioner for Patents of the United States Patent and Trademark Office*

In the Claims

Claim 12, Column 14, line 33, reads "rollers engage said first pair of grooves when said adaptor is"
should read -- rollers engages said first pair of grooves when said adaptor is --

Claim 12, Column 14, line 38, reads "and such that said pair of rollers engage said second pair of"
should read -- and such that said pair of rollers engages said second pair of --

Claim 14, Column 14, line 53, reads "such that said pair of rollers engage said first pair of grooves"
should read -- such that said pair of rollers engages said first pair of grooves --

Claim 14, Column 14, line 59, reads "engage said second pair of grooves when said adaptor is in a"
should read -- engages said second pair of grooves when said adaptor is in a --